US005591016A

United States Patent [19]

Kubota et al.

[11] Patent Number: 5,591,016

[45] Date of Patent: Jan. 7, 1997

[54] MULTISTAGE CANNED MOTOR PUMP HAVING A THRUST BALANCING DISK

[75] Inventors: Yasushi Kubota; Yoshiaki Konishi; Masaaki Eguchi, all of Tokyo, Japan

[73] Assignee: Nikkiso Co., Ltd., Tokyo, Japan

[21] Appl. No.: 347,034

[22] Filed: Nov. 30, 1994

[51] Int. Cl.[6] ..... F04B 17/00

[52] U.S. Cl. ..... 417/365; 417/370; 417/366; 415/104

[58] Field of Search ..... 417/365, 366, 417/369, 370, 423.12; 415/104, 106

[56] References Cited

U.S. PATENT DOCUMENTS

| | | | |
|---|---|---|---|
| 2,809,590 | 10/1957 | Brown | 417/365 |
| 3,220,349 | 11/1965 | White | 417/365 |
| 3,288,073 | 11/1966 | Pezillo | 417/370 |
| 3,664,758 | 5/1972 | Sato | 417/365 |
| 3,746,461 | 7/1973 | Yokota | 415/104 |
| 4,115,038 | 9/1978 | Litzenberg | 417/365 |
| 5,009,578 | 4/1991 | Hyland | 417/365 |
| 5,340,272 | 8/1994 | Fehlau | 415/104 |

FOREIGN PATENT DOCUMENTS

| | | | |
|---|---|---|---|
| 261695 | 11/1987 | Japan | 417/366 |
| 779654 | 11/1980 | U.S.S.R. | 415/104 |
| 1138541 | 2/1985 | U.S.S.R. | 415/104 |
| 1252554 | 8/1986 | U.S.S.R. | 415/104 |
| 935585 | 8/1963 | United Kingdom | 417/370 |

*Primary Examiner*—Timothy S. Thorpe
*Assistant Examiner*—Ted Kim
*Attorney, Agent, or Firm*—Robert D. Schaffer; Rogers & Wells

[57] ABSTRACT

A multistage canned motor pump comprising a pump section including a plurality of pump chambers and a motor section behind the pump section, both the sections having in common a single rotation shaft, and further a balance disk between the pump and motor sections, wherein an external circulation system is provided so that a part of a treating liquid discharged from a last stage pump chamber is circulated from a front rotor chamber through a pressure chamber accommodating the balance disk to a rear rotor chamber while the remaining part of the treating liquid is supplied to a rear bearing section for lubrication of the bearing section and further circulated through an external pipe to a pump section port for cooling of the motor section, and wherein an annular balance sheet is provided a verge at a high pressure side of the balance disk in the pressure chamber to control a flow rate of the treating liquid to thereby reduce a pressure of a circulation flow of the treating liquid toward the motor section.

2 Claims, 21 Drawing Sheets

MULTISTAGE CANNED MOTOR PUMP HAVING A THRUST BALANCING DISK

BACKGROUND OF THE INVENTION

The invention relates to a multistage canned motor pump, and more particularly to a multistage canned motor pump provided between a motor section and a pump section with a balance disk for proper control of a thrust balance.

It has been known in the prior art for proper control of the thrust balance multistage canned motor pumps utilize either an automatic balance feature or a self balance system in which impellers are provided to face each other.

FIG. 1 illustrates the conventional multistage canned motor pump with the automatic balance feature in which a multistage canned motor pump 10 includes a plurality of pump chambers 13 provided in individual stages of the pump. Each of the pump chambers 13 has an impeller 16 being provided with a balance hole 18 and a fixed orifice 20 at a rear side of the impeller so as to control the thrust balance.

The self balance system in which impellers are provided to face each other is disclosed in the Japanese Patent Publication No. 4-51678.

In the multistage canned motor pump having the automatic balance feature as illustrated in FIG. 1, a pressure of the last stage pump chamber **13*a* in the pump section 12 is directly applied to a chamber of the motor section 14. For that reason, the structure of the rotor chamber is designed in its strength to bear a pressured raised up by the final stage of the pump section 12**.

Increase of the number of the stages results in a high head thereby designing the pump to bear a high pressure is necessary. This requires a thick can or a thick backup sleeve. The driving motor is required to bear the high pressure. Driving the motor capable of bearing the high pressure requires a large current thereby resulting in an increase of an energy loss. This therefore results in a lowering of the pump efficiency.

In the multistage canned motor pump with the self balance system, the rotor chamber is applied with a pressure of the intermediate stage of the pump section. However, in a large number of the stages of the pump section, the rotor chamber has to be designed to bare the high pressure. Further, it is required to provide a flow passage for introducing a treating liquid into a reverse impeller facing to a counterpart impeller. This makes the structure of the pump section complicated thereby resulting in an increase of the manufacturing cost.

In the conventional multistage pump with the balance disk, the balance disk 22 at its side abutting to a behind chamber 24 is connected through a circulation system 26 to a pump inlet port side chamber **25*a* to keep a low pressure of the pump section as illustrated in FIGS. 2A and 2**B.

Normally, it is preferable to provide a circulation system in the multistage canned motor pump for cooling the motor section and lubrication of the bearings in which the circulation system has the same direction flow as that of the balance disk as providing a simple structure rather than the reverse direction.

The canned motor pump has the advantage of no leakage. Providing the circulation system at an exterior of the pump section requires an increase of the number of the sealing members. This provides an increase of a possibility of generation of the leakage. To combat this problem, as illustrated in FIG. 3, mainly used is a single stage canned motor pump 30 in which a through hole 34 is provided on a motor rotor 32 to permit a part of the treating liquid is circulated into a pump inlet port 25 or to establish an internal circulation system.

In applying such the system to the multistage canned motor pump with the balance disk, the following problems are generated. In the multistage canned motor pump, the pump axis and the motor axis are united to form a single motor rotor thereby resulting in a large longitudinal length of the canned motor pump. A diameter of the through hole on the shaft depends upon a strength of the shaft thereby a pressure loss due to the through hole is increased and then a pressure of the behind chamber provided behind the balance disk is raised up. This makes it difficult to keep the balance.

The internal circulation system may provide advantages in less leakage and a reduced manufacturing cost. The thrust balance feature using the balance disk may implement the stable balance over the all flow region and require no balance hole nor annular sealing member in the rear side. This may reduce the leakage loss and the disk friction loss to improve the pump efficiency. Then, the internal circulation system using the balance disk system has been used.

In a one-side suction multistage pump, a pump thrust directed to the section side is generated. To prevent this bias of the thrust, a rotation balance disk is normally used for the thrust balance feature.

In the thrust balance feature of FIG. 4, is bypassed through a high pressure chamber 46 and a low pressure chamber 48 to the low pressure suction port wherein the high and low pressure chambers are separated through an aperture 44 with a gap g between a rotation balance disk 40 and a balance sheet 42. The aperture 44 provides a pressure drop by which a balance between a balance thrust $T_B$ generated between the balance chambers 46 and 48 and the pump thrust $T_P$.

Increase of the pump thrust $T_P$ makes the shaft 15 move in the pump thrust direction thereby the gap g is reduced. This may increase the pressure drop due to the aperture 44 thereby the balance thrust $T_B$ is increased. By contrast, when the pump thrust $T_P$ is reduced, the rotor shaft 15 moves to the balance thrust thereby the gap g is increased. This provides a reduction of the pressure drop due to the aperture 44 thereby a balance thrust $T_B$ is reduced. Then, the rotor shaft 15 moves automatically to such a position that both the pump thrust $T_P$ and the balance thrust $T_B$ are the same as each other thereby the both thrusts are set off. The thrusts $T_P$ and $T_B$ are given by the following equation (1) and illustrated in FIG. 5.

$$\begin{aligned} T_P &= T_B = P_{46'} - P_{48'} \\ &= (r_B/r_S) \times (p_{2'} - p_{1'}) 2\pi r dr \\ &= (r_B/r_S) \times (p_{2'} - p_{3'}) 2\pi r dr \end{aligned} \quad (1)$$

where $P_{46'}$ and $P_{48'}$ are high and low pressures of the high and low pressure chambers 46 and 48 respectively, $r_B$ and $r_S$ are the outer and inner diameters of the balance disk 40. $p_{1'}$, $p_{2'}$ and $p_{3'}$ are pressure at the position I of the inner diameter of the high pressure balance chamber 46, at the position II of the output port of the aperture 44 and at the position III of the outer diameter of the low pressure balance chamber 48.

The above conventional thrust balance feature is still engaged with problems as described below. Normally, the multistage pump requires the high head and the large capacity. The high head and the large capacity requires the increase of the number of the stages in the pump section thereby the pump thrust is also increased. To keep the balance, the balance thrust is required to be increased. The increase of the balance thrust needs specific design modifications thereby the manufacturing cost and the friction loss are increased.

In the structure as illustrated in FIG. 4, increase of the pump thrust $T_p$ causes a reduction of the gap g of the aperture 44 between the balance disk 40 and the balance sheet 42. In the conventional thrust balance feature, when the high head and large capacity pump is driven in a relatively large flow rate and in a low head region, the gap g is reduced excessively so that the balance disk 40 and the balance sheet 42 are made contact with each other. To prevent this problem, it is required to enlarge the outer diameter $r_B$ of the balance disk 40.

Such method of enlargement of the outer diameter is carried out by an enlargement of the both balance chambers 46 and 48 including the balance disk 40 and the balance sheet 42 and other elements. This results in an increase of the manufacturing cost and in a lowering of the pump efficiency. Notwithstanding, the minimization of the sizes of the pump constitutional elements such as the balance disk is preferable. The above problems are caused by an insufficient balance thrust due to a pressure generation feature of the conventional thrust balance feature. It is therefore required to solve the problem.

The description will focus on the structure and operations of the pressure generation feature. With reference to FIG. 4, in a space S between the both chambers 46 and 48, a rotation flow of the treating liquid is generated due to the rotation of the balance disk 40. The rotation flow may be regarded as a compulsory swirl flow relative to the rotation speed of the balance disk. The rotation flow is given by the following two equations.

$$u=Kr\omega$$

where u is the peripheral speed of the treating liquid, r is the radius, ω is the angular speed of the balance disk and K is the specific peripheral speed.

$$p=\rho/2\times K^2(r_o^2-r_i^2)\omega^2$$

where Δp is the difference in pressure in the space S, ρ is the density of the treating liquid, $r_o$ is the outer radius and $r_i$ is the inner radius.

From the above, it could be understood that the specific peripheral speed K is given by the function of the space S and the outer diameter $r_B$. It has been known in the art that the value of the specific peripheral speed K is in the range of from 0.5 to 0.4 in the space as illustrated in FIG. 4.

In FIG. 5, both components of the balance thrust $T_B$ generated in the both balance chambers 46 and 48, or both pressures $P_{46'}$ and $P_{48'}$ are represented by areas $P_{46'}$ and $P_{48'}$ defined by lines $L_{46'}$ and $L_{48'}$ and a vertical axis r. The balance thrust $T_B$ is large as the high pressure balance chamber 46 has a large pressure $P_{46'}$ and the low pressure balance chamber 48 has a low pressure $P_{48'}$.

In the conventional thrust balance feature, it is difficult to enlarge the balance thrust because of the difficulty in providing a sufficient high pressure to the high pressure balance chamber and a sufficient low pressure to the low pressure balance chamber. Those matters may readily be appreciated from the lines $L_{46'}$ and $L_{48'}$. Those also means that the values of the specific peripheral speed K are set in the range of from 0.5 to 0.4 and at about 0 respectively. The causes of the above are that in the high pressure balance chamber 46 a relatively high speed rotation flow is generated thereby resulting in a rapid drop of the pressure of the treating liquid, while in the low pressure balance chamber 48 a relatively low speed rotation flow is generated thereby resulting in almost no variation of the pressure of the treating liquid.

The conventional thrust balance feature provides the high head and large capacity multistage pump with an insufficient balance thrust. To solve this problem, a large scale design modification is required of the pump. This may result in an increase of the manufacturing cost and in an increase of the friction loss.

As illustrated in FIG. 6, the multistage canned motor pump 10 comprises the multistage pump section 12 and the canned motor section 14 have the single rotor shaft 15 in common wherein the rotor shaft 15 is supported by a pair of bearings 17 and the circulation pipe 26 is provided for circulation of the treating liquid so that a part of the treating liquid is circulated within the motor section 14 for lubrication and cooling of the bearings 17 and the motor section 14.

As illustrated in FIG. 7, the adjacent pump chambers 13 constituting the pump section 12 are connected to each other through a fixed joint member 52 comprising an engaging hole between chamber walls 50 and through a slidable joint member 54 comprising a passage extending both along the rotor shaft 15 and between the chamber wall and a rotation boss 16*a* of the impeller 16. The fixed and slidable joint members 52 and 54 are provided with an O-ring 56 and an annular seal ring 58 respectively to prevent the leakage of the treating liquid from the high pressure pump stage to the low pressure pump stage.

The above described scaling structure has serious problems as described below. The conventional sealing structure comprises the fixed joint member 52 with the O-ring 56 and the slidable joint member 54 with the annular sealing member 58. The fixed joint member 52 is surely able to prevent any leakage by the O-ring 56, while the slidable joint member 54 makes it difficult to surely seal by the annular seal ring 58 because the annular seal ring 58 requires a large gap of sealing face as illustrated in FIG. 7, unlike the normal multistage pump.

In the multistage canned motor pump, the rotor shaft 15 is supported by a pair of the bearings 17 that are made of carbon or ceramic in place of alloys used in the normal multistage pump. The carbon or ceramic bearings is designed to have a large gap rather than that of the normal multistage pump due to a deterioration of the slidable property. The slidable joint member 54 constituting the scaling member between individual pump stages is designed to have a larger sealing area gap of the annular sealing 58 rather than the bearing area gap due to a large vibration of the rotor shaft 15. For that reason, the annular sealing member is obliged to have a poor sealing property.

The large sealing area gap may result in a poor sealing property of the annulare sealing member. A characteristic curve La' represented by a broken line in FIG. 23 shows that if a difference in pressure between individual stages of the pump section is raised, then an amount of the leakage q is also increased rapidly. A characteristic curve Lb' represented by a broken line in FIG. 24 shows that if a difference in pressure between individual stages of the pump section is raised, then the pump efficiency is lowered largely as compared to the normal multistage pump. The sealing area gap is enlarged by a frictional wear of the annulare sealing member 58 due to the eccentric vibration of the rotor shaft 15 caused by the frictional wear of the bearings 17. The increase of the gap may promote the lowering of the pump efficiency particularly due to the pump head and aged deterioration. The increase of the amount of the leakage q or the lowering of the pump efficiency may be somewhat prevented by enlarging the length in the axial direction of the annulare sealing member 58, but not may be prevented completely. In this case, an enlargement of the slidable point member 54 is required thereby the individual pump chamber 13 is also enlarged, resulting in an enlargement of the pump section 12.

The sealing structure between the individual pump stages in the canned motor pump is forced to be engaged with the problems with lowering of the pump efficiency due to a relatively large amount of the leakage and aged deterioration of the pump performances as well as the problem with an increase of the number of the pump stages.

SUMMARY OF THE INVENTION

Accordingly, it is an object of the present invention to provide a multistage canned motor pump with an improved structure between a pump section and a motor section being capable of control a pressure of a treating liquid introduced into the motor section.

It is a further object of the present invention to provide a multistage canned motor pump with a simple structure and a reduced manufacturing cost.

It is a furthermore object of the present invention to provide a multistage canned motor pump with an improved pump efficiency.

It is a still further object of the present invention to provide a multistage canned motor pump with an improved motor efficiency.

It is another object of the present invention to provide a multistage canned motor pump capable of keeping a stable thrust to improve a pump efficiency.

It is still another object of the present invention to provide a multistage canned motor pump with a high reliability and a low price.

It is an additional object of the present invention to provide a multistage canned motor pump with an improved balance thrust to obtain an applicability to a high head and large capacity multistage pump without any large scale modifications of the standard elements.

It is a moreover object of the present invention to provide a sealing structure between individual stages in a pump section involved in a multistage canned motor pump capable of improving a pump efficiency and preventing any aged deterioration of pump performances.

It is yet a further object of the present invention to provide a sealing structure between individual stages in a pump section involved in a multistage canned motor pump capable of reducing the number of the pump stages to provide a simple structure of the individual stage.

The above and other objects, features and advantages of the present invention will be apparent from the following descriptions.

The invention provides a multistage canned motor pump comprising a pump section including a plurality of pump chambers, a motor section behind the pump section and a balance disk between the pump and motor sections, wherein an external circulation system is provided so that a part of a treating liquid discharged from a last stage pump chamber is circulated from a front rotor chamber through a pressure chamber accommodating the balance disk to a rear rotor chamber while the remaining part of the treating liquid is supplied to a rear bearing section for lubrication of the bearing section and further circulated through an external pipe to a pump section port for cooling of the motor section, and wherein an annulare balance sheet is provided a verge at a high pressure side of the balance disk in the pressure chamber to control a flow rate of the treating liquid to thereby reduce a pressure of a circulation flow of the treating liquid toward the motor section.

The invention also provides a multistage canned motor pump comprising a pump section including a plurality of pump chambers, a motor section behind the pump section and a balance disk between the pump and motor sections, wherein an internal circulation system is provided so that a part of a treating liquid discharged from a last stage pump chamber is circulated from a front rotor chamber through a pressure chamber accommodating the balance disk placed behind and adjacent to the last pump stage to a rear rotor chamber while the remaining part of the treating liquid is supplied to a rear bearing section for lubrication of the bearing section and further circulated through a shaft through hole provided a rear end portion of a motor rotor shaft to a pump section port for cooling of the motor section, and wherein the pressure chamber is isolated into front and rear chambers through the balance disk being provided on opposite outer side ends thereof with annulare balance sheets and the balance disk is provided on its rear chamber side with a projecting portion to form a balance chamber that may seal inner peripheral verge of the rear side balance sheet, and wherein the pressure chamber is provided with a passage connecting between a gap outside the rear side balance sheet and the front rotor chamber as well as wherein the balance disk is provided on its contact face to the rotor shaft with a balance through hole connecting between the balance chamber and the shaft through hole.

In the above case, the balance through hole connecting to the shaft through hole of the motor rotor shaft may be provided on the suction side of at least one of the pump chambers.

The invention provides a thrust balance feature of a multistage canned motor pump in which a high pressure treating liquid discharged from a discharge side of a last stage impeller is bypassed through high and low pressure side chambers isolated by a rotation balance disk and a disk sheet aperture between fixed walls into a low pressure suction side wherein a suppression section for suppressing a circulation flow of the treating liquid is provided on a fixed wall of the high pressure side balance chamber.

The invention provides a thrust balance feature of a multistage canned motor pump in which a high pressure treating liquid discharged from a discharge side of a last stage impeller is bypassed through high and low pressure side chambers isolated by a rotation balance disk and a disk sheet aperture between fixed walls into a low pressure suction side wherein a promotion section for promoting a circulation flow of the treating liquid is provided on the rotation balance in the low pressure balance chamber.

The invention provides a thrust balance feature of a multistage canned motor pump in which a high pressure treating liquid discharged from a discharge side of a last stage impeller is bypassed through high and low pressure side chambers isolated by a rotation balance disk and a disk sheet aperture between fixed walls into a low pressure suction side wherein a suppression section for suppressing a circulation flow of the treating liquid is provided on a fixed wall of the high pressure side balance chamber and further a promotion section for promoting a circulation flow of the treating liquid is provided on the rotation balance in the low pressure balance chamber.

It may be available that the suppression and promotion sections may comprise a radical convex portion provided on the fixed wall and a radical concave portion provided on the rotation balance disk respectively.

The invention also provides a sealing structure between individual pump stages involved in a canned motor pump comprising a multistage pump section and a canned motor pump section, both of which have in common a single rotation shaft supported by a pair of bearings in the motor section and the bearings and the motor section are cooled and lubricated by a circulation flow of a part of a treating liquid, wherein an annular sealing member is provided slidably in a longitudinal direction of the rotation shaft in a slidable joint member formed between individual adjacent pump stages so that the sealing member is securely pressed by a pressure difference between the adjacent two pump stages on one having a lower pressure of the adjacent two stages for sealing of the slidable joint member.

In this case, the slidable joint member may comprise an axial passage extending in the longitudinal direction of the rotor shaft from a stage of the high pressure chamber to a stage of the low pressure chamber between the fixed wall of the pump chamber and a rotation boss of the impeller and a radius passage extending in a radius direction to vertically across the axial passage so that the sealing member is able to side in the axial passage in the rotation axis direction with keeping a seal against the fixed wall to thereby form a radius sealing face in the radius passage between the sealing member and the rotation boss of the impeller.

The sealing member may be so constituted that a low pressure receiving area is larger than a high pressure receiving area. The sealing member may also be so constituted that a slidable outer face is provided with a metal sleeve fixed thereon.

According to the present invention, an external circulation system is provided so that a part of a treating liquid discharged from a last stage pump chamber is circulated from a front rotor chamber through a pressure chamber accommodating the balance disk to a rear rotor chamber while the remaining part of the treating liquid is supplied to a rear bearing section for lubrication of the bearing section and further circulated through an external pipe to a pump section port for cooling of the motor section, and further an annulare balance sheet is provided a verge at a high pressure side of the balance disk in the pressure chamber to control a flow rate of the treating liquid to thereby reduce a pressure of a circulation flow of the treating liquid toward the motor section. This results in that a pressure of the treating liquid is held at a low value thereby permitting the rotor chamber to have a simple structure. Pump and motor efficiencies are improved.

According to the invention, an internal circulation system is provided so that a part of a treating liquid discharged from a last stage pump chamber is circulated from a front rotor chamber through a pressure chamber accommodating the balance disk placed behind and adjacent to the last pump stage to a rear rotor chamber while the remaining part of the treating liquid is supplied to a rear bearing section for lubrication of the bearing section and further circulated through a shaft through hole provided a rear end portion of a motor rotor shaft to a pump section port for cooling of the motor section, and further the pressure chamber is isolated into front and rear chambers through the balance disk being provided on opposite outer side ends thereof with annulare balance sheets and the balance disk is provided on its rear chamber side with a projecting portion to form a balance chamber that may seal inner peripheral verge of the rear side balance sheet, and moreover the pressure chamber is provided with a passage connecting between a gap outside the rear side balance sheet and the front rotor chamber as well as the balance disk is provided on its contact face to the rotor shaft with a balance through hole connecting between the balance chamber and the shaft through hole. As a result, a stability of the thrust is improved.

According to the present invention, a high pressure treating liquid discharged from a discharge side of a last stage impeller is bypassed through high and low pressure side chambers isolated by a rotation balance disk and a disk sheet aperture between fixed walls into a low pressure suction side wherein a suppression section for suppressing a circulation flow of the treating liquid is provided on a fixed wall of the high pressure side balance chamber. Alternatively, a promotion section for promoting a circulation flow of the treating liquid is provided on the rotation balance in the low pressure balance chamber. Alternatively, a suppression section for suppressing a circulation flow of the treating liquid is provided on a fixed wall of the high pressure side balance chamber and further a promotion section for promoting a circulation flow of the treating liquid is provided on the rotation balance in the low pressure balance chamber.

According to the present invention, there is provided a sealing structure between individual pump stages involved in a canned motor pump comprising a multistage pump section and a canned motor pump section, both of which have in common a single rotation shaft supported by a pair of bearings in the motor section and the bearings and the motor section are cooled and lubricated by a circulation flow of a part of a treating liquid, wherein an annular sealing member is provided slidably in a longitudinal direction of the rotation shaft in a slidable joint member formed between individual adjacent pump stages so that the sealing member is securely pressed by a pressure difference between the adjacent two pump stages on one having a lower pressure of the adjacent two stages for sealing of the slidable joint member.

BRIEF DESCRIPTIONS OF THE DRAWINGS

Preferred embodiments of the present inventions will hereinafter be described in detail with reference to the accompanying drawings.

PREFERRED EMBODIMENTS OF THE INVENTIONS

Figure 1:
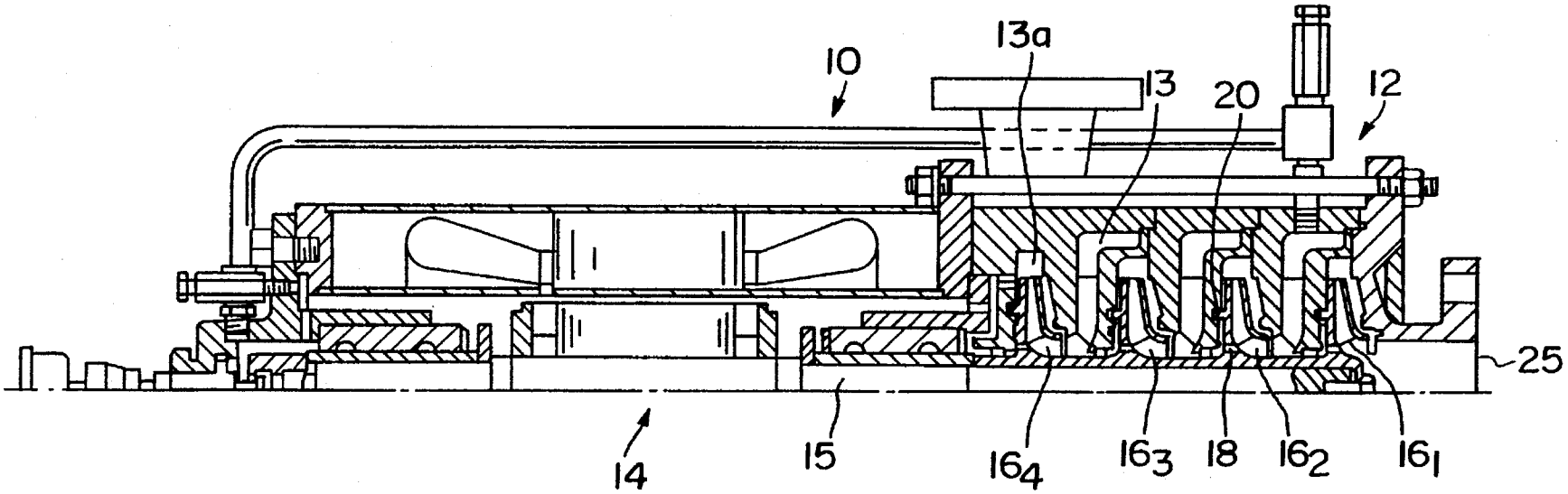
FIG. 1 PRIOR ART
FIG. 1 is a half cross sectional elevation view illustrative of the conventional multistage canned motor pump.
Figure 2A:
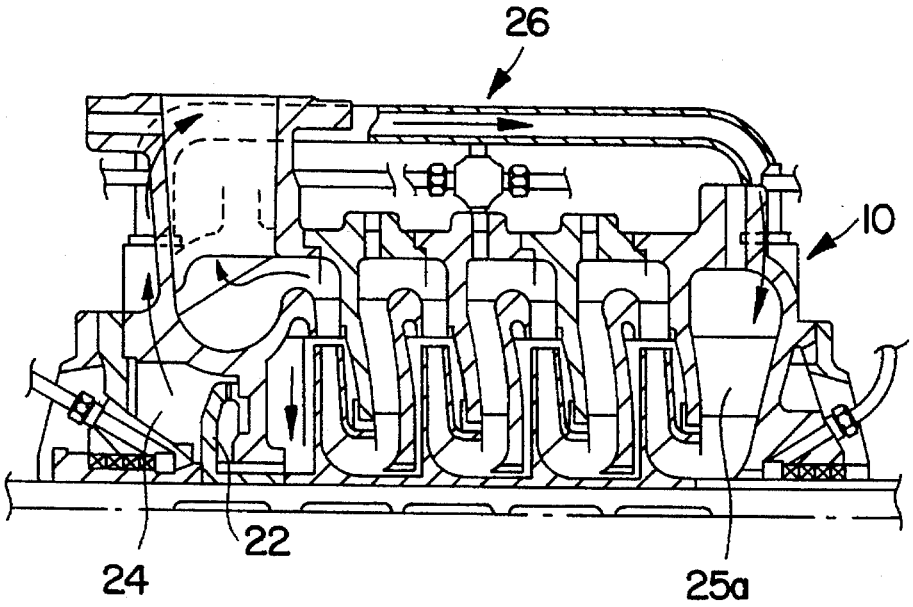
FIG. 2A PRIOR ART
FIG. 2A is a half cross sectional elevation view illustrative of the conventional multistage canned motor pump utilizing an external circulation system.
Figure 2B:
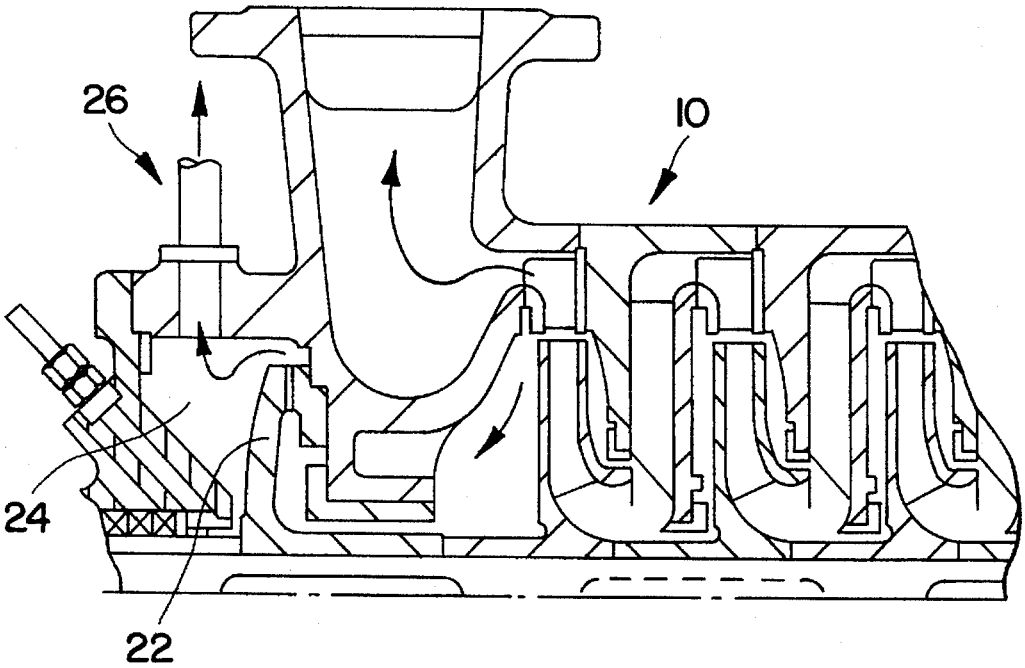
FIG. 2B PRIOR ART
FIG. 2B is an enlarged cross sectional elevation view illustrative of the conventional balance feature in the multistage canned motor pump
Figure 3:
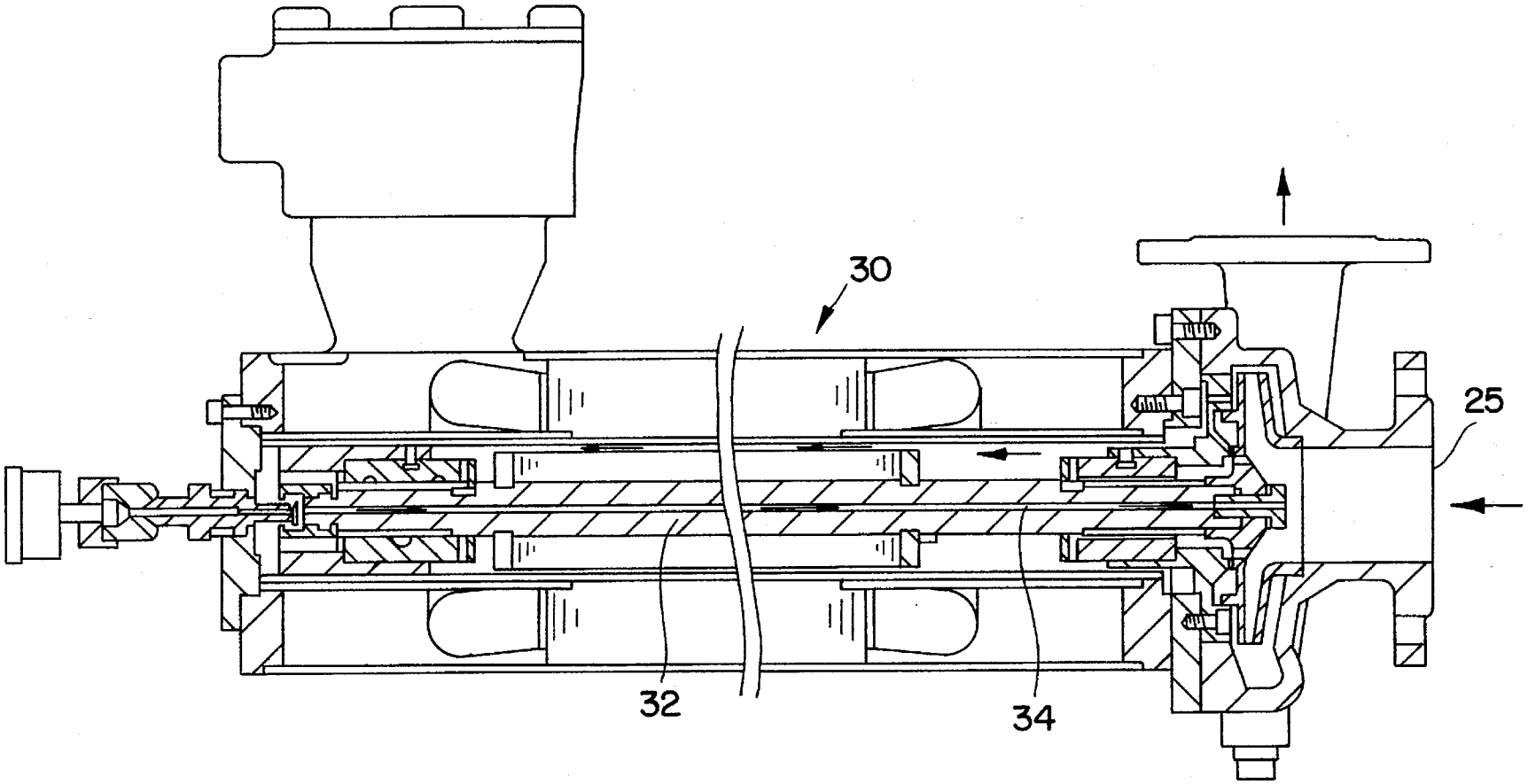
FIG. 3 PRIOR ART
FIG. 3 is a half cross sectional elevation view illustrative of the conventional singlestage canned motor pump utilizing an internal circulation system.
Figure 4:
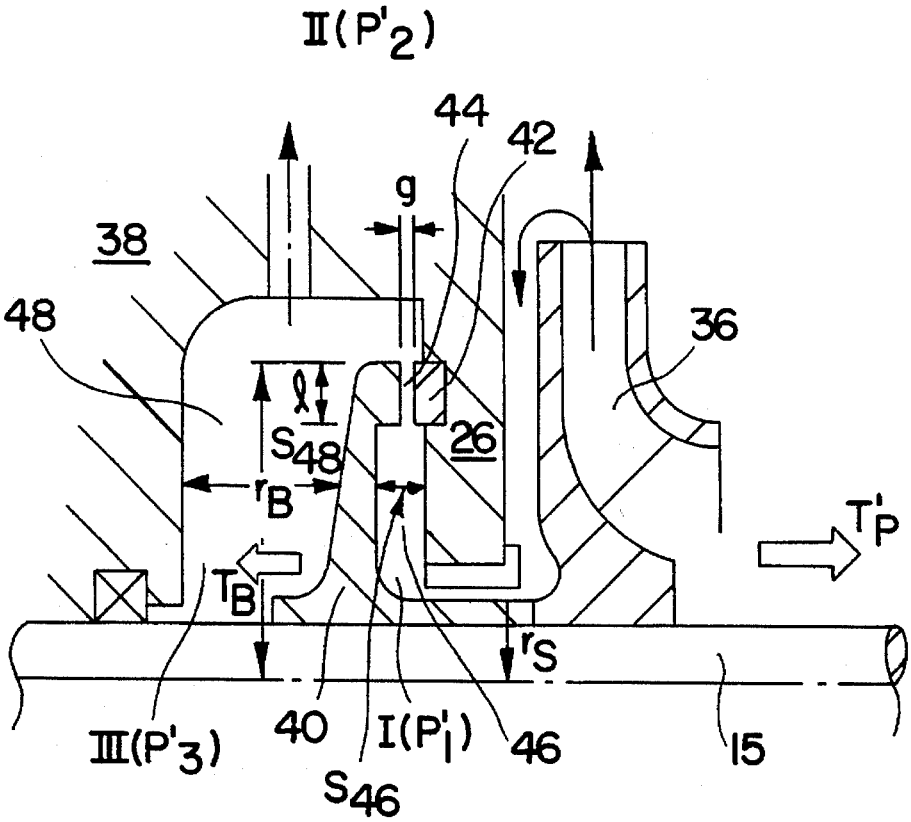
FIG. 4 PRIOR ART
FIG. 4 is an enlarged cross sectional elevation view illustrative of the conventional thrust balance feature.
Figure 5:
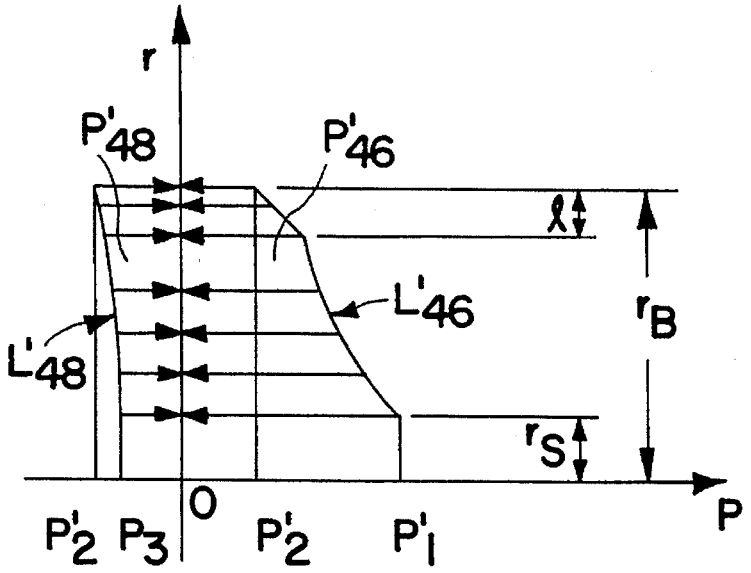
FIG. 5 PRIOR ART
FIG. 5 is a diagram of a radius-pressure characteristic curve of the thrust balance feature of FIG. 4.
Figure 6:
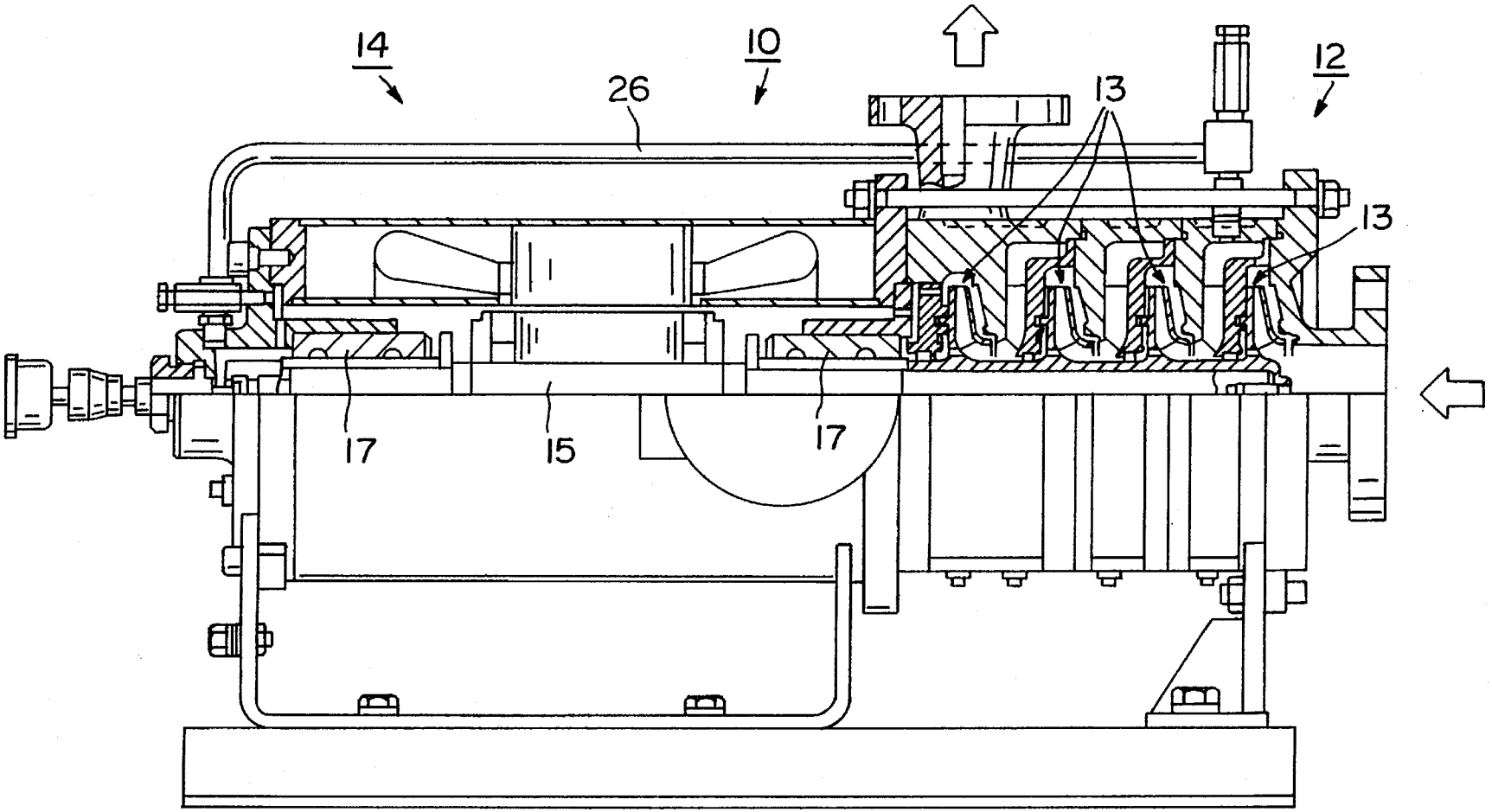
FIG. 6 PRIOR ART
FIG. 6 is a half cross sectional elevation side view illustrative of the conventional multistage canned motor pump.
Figure 7:
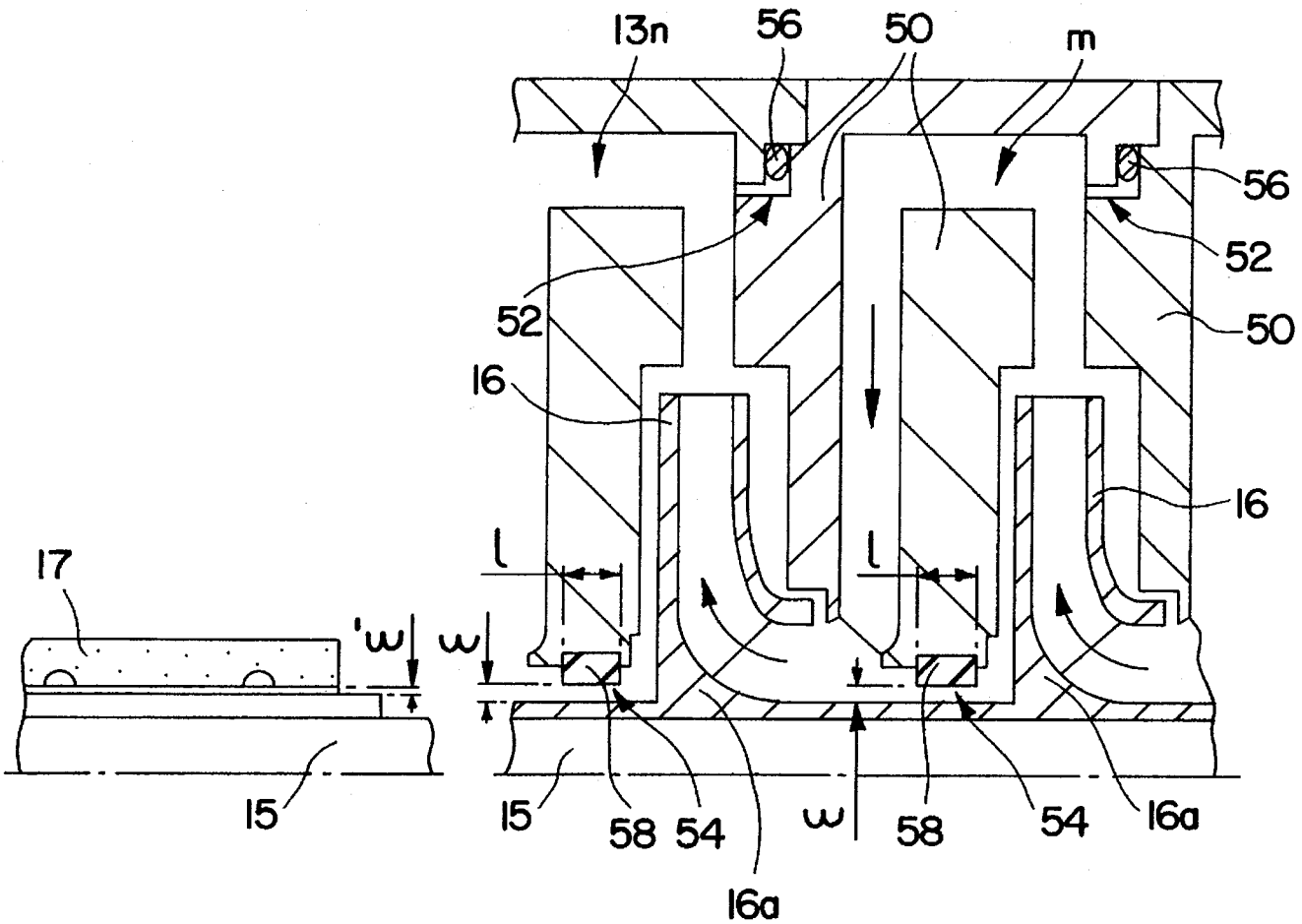
FIG. 7 PRIOR ART
FIG. 7 is an enlarged cross sectional elevation view illustrative of the conventional sealing structure between individual pump stages of the canned motor pump.
Figure 8A:
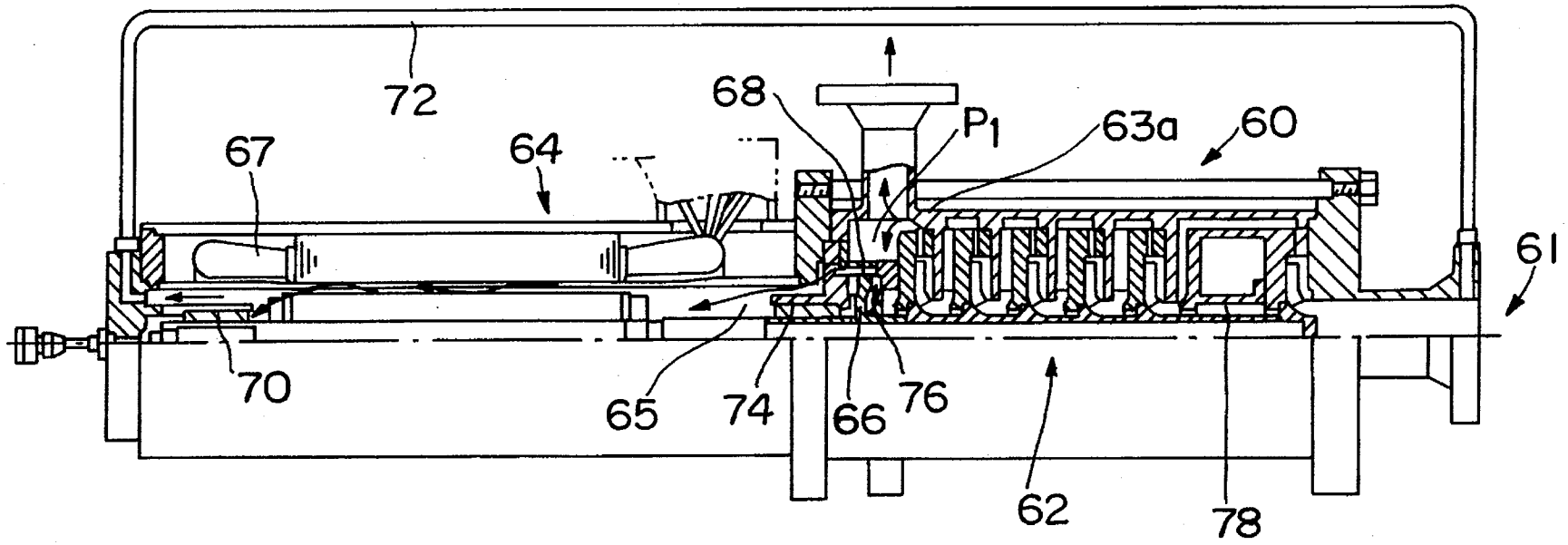
FIG. 8A is a half cross sectional elevation view illustrative of a novel multistage canned motor pump in a first embodiment according to the present invention.
Figure 8B:
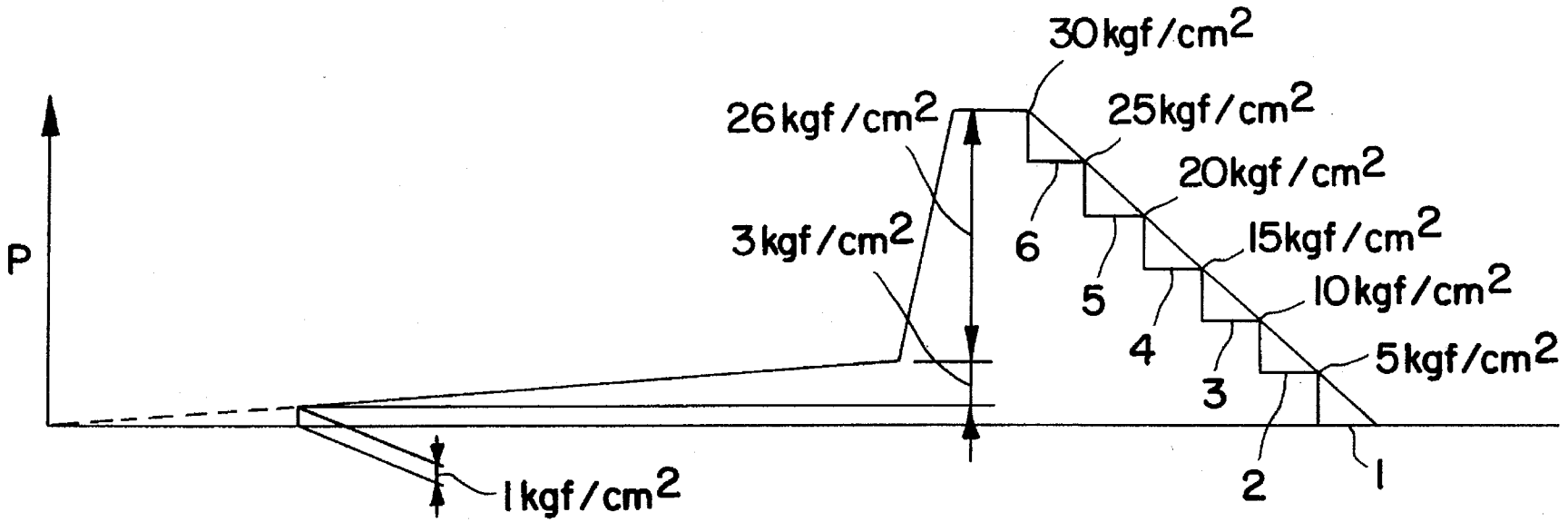
FIG. 8B is a diagram illustrative of pressure curves of each positions of a novel multistage canned motor pump in a first embodiment according to the present invention.

A first embodiment according to the present invention will be described in FIGS. 8A and 8B, there is provided a multistage canned motor pump 60 comprising a pump section 62 including a plurality of pump chambers 63, a motor section 64 behind the pump section 62 and a pressure chamber 68 accommodating a balance disk 66 between the pump and motor sections.

Figure 9:
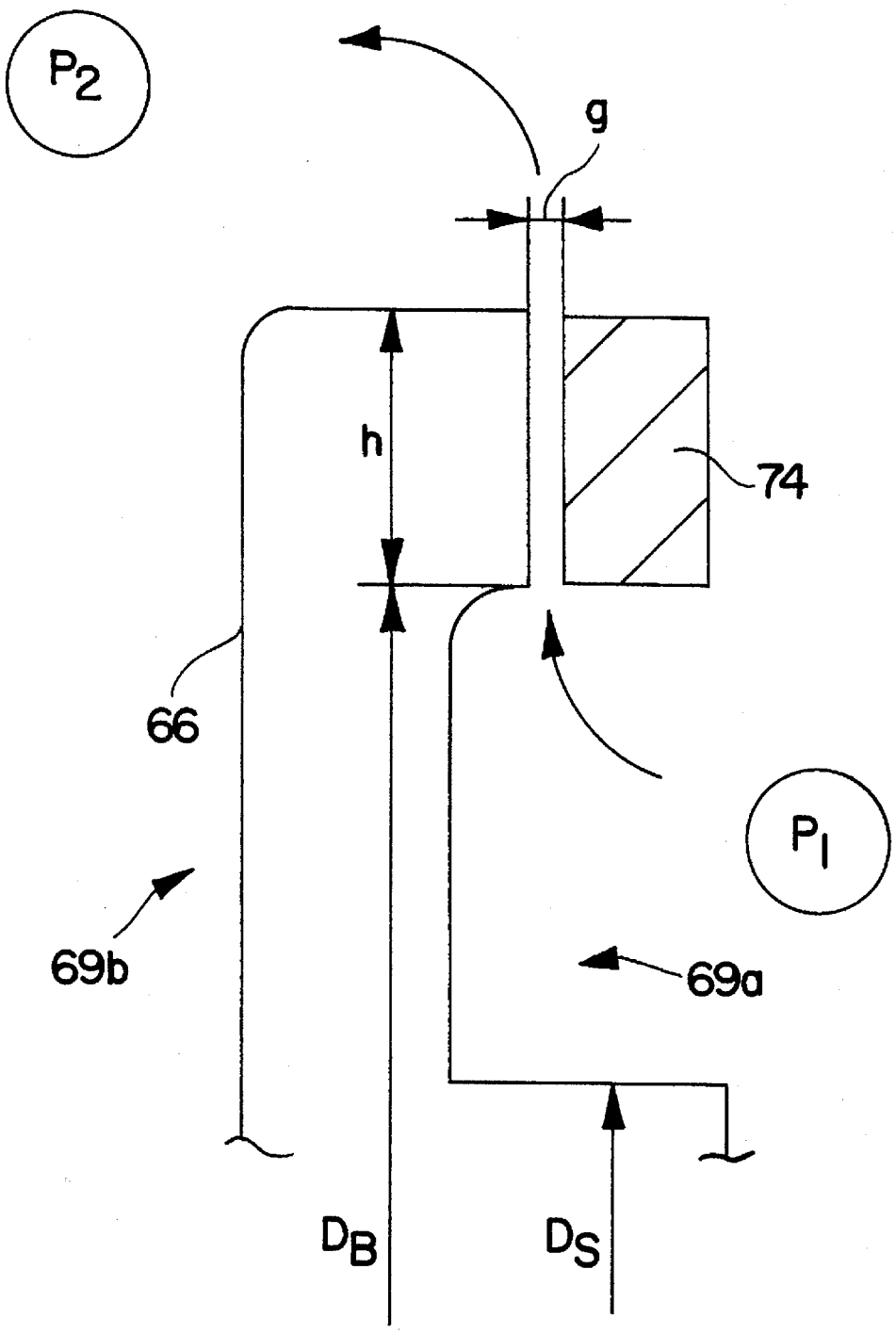
FIG. 9 is a view illustrative of a balance disk sheet of a novel multistage canned motor pump in a first embodiment according to the present invention.

In the multistage canned motor pump 60, an external circulation system is provided so that a treating liquid is suctioned into a suction port 61 and thereafter discharged from a last stage 63*a* of the pump chambers 63. A part of the discharged treating liquid is subsequently circulated from a front rotor chamber 65 through a pressure chamber 68 accommodating the balance disk and being placed behind the last stage pump chamber 63*a* to a rear rotor chamber 67. On the other hand, the remaining part of the discharged treating liquid is supplied to a rear bearing section 70 for lubrication of the bearing section 70 and thereafter circulated through an external pipe 72 to a pump section port 61 for cooling of the motor section 64 and for lubrication of a rear bearing 70 and an intermediate bearing 74 the pressure chamber 68 accommodating the balance disk 66 is divided as illustrated in FIG. 9 into front and rear chambers 69*a* and 69*b* through the balance disk 66. An annulare balance sheet 76 is provided to have a gap from a verge at a high pressure side of the balance disk 66 in the pressure chamber 68 to control a flow rate of the treating liquid to thereby reduce a pressure of a circulation flow of the treating liquid toward the motor section 64.

The amount q of the leakage through the gap is given by the following equation.

$$q = C\pi D_B g \sqrt{(2g\,(P_2 \cdot P_1))}$$

$$C = 1/\sqrt{(0.02\,(h/g) + 1.5)}$$

where q is the leakage amount, g is the gap, $D_B$ is the effective diameter, $P_1$ and $P_2$ are the high and low pressures respectively.

The values $D_B$, h and g are set so that the value q is sufficient for cooling of the motor section 64 and a proper pressure difference $\Delta P-(P_2 \cdot P_1)$ is obtained. In every pump chambers, a pressure is raised by 5 kgf/cm$^2$ so that the last stage pressure reaches 30 kgf/cm$^2$.

The balance disk sheet 74 is placed adjacent to the balance disk so that a pressure of the treating liquid in flowing through the gap between the balance disk sheet and the balance disk is raised up. Flowing the pressure-raised treating liquid may provide a sufficient pressure drop to a lower value by 26 kgf/cm$^2$ than the maximum circulation pressure. As a result, a pressure loss in the motor section 64 is 3 kgf/cm$^2$ only as well as a pressure loss at a rear side position of the external pipe 72 is 1 kgf/cm$^2$ only.

Even in a multistage pump having a discharge pressure of several ten kgf/cm$^2$, the novel feature may permit a low pressure of one or more kgf/cm$^2$.

Using the novel trust balance feature may permit the impeller without rear side orifice or balance hole. As a result, thereby is no problem with leakage through the balance hole and there is no disk friction loss due to the fixed orifice thereby a pump efficiency is improved by a few percent.

a second embodiment according to the present invention will be described in FIGS. 10A AND 10, there is provided a multistage canned motor pump 80 comprising a pump section 82 including a plurality of pump chambers 83, a motor section 84 behind the pump section 82 and a balance disk 86 between the pump and motor sections 82 and 84. An internal circulation system is provided so that a treating liquid is suctioned into a suction port 81 and then discharged from a last stage pump chamber 83*a*. A part of the discharged treating liquid is circulated from a front rotor chamber 85 through a pressure chamber 88 accommodating the balance disk 86 placed behind and adjacent to the last pump stage 83*a* to a rear rotor chamber 87, while the remaining part of the discharged treating liquid is supplied to a rear bearing section 90 for lubrication of the bearing section 90 and further circulated through a shaft through hole 96 provided a rear end portion of a motor rotor shaft 95 to the pump section port 81 for cooling of the motor section 84 and lubrications of rear and intermediate bearings 90 and 94.

Figure 11:
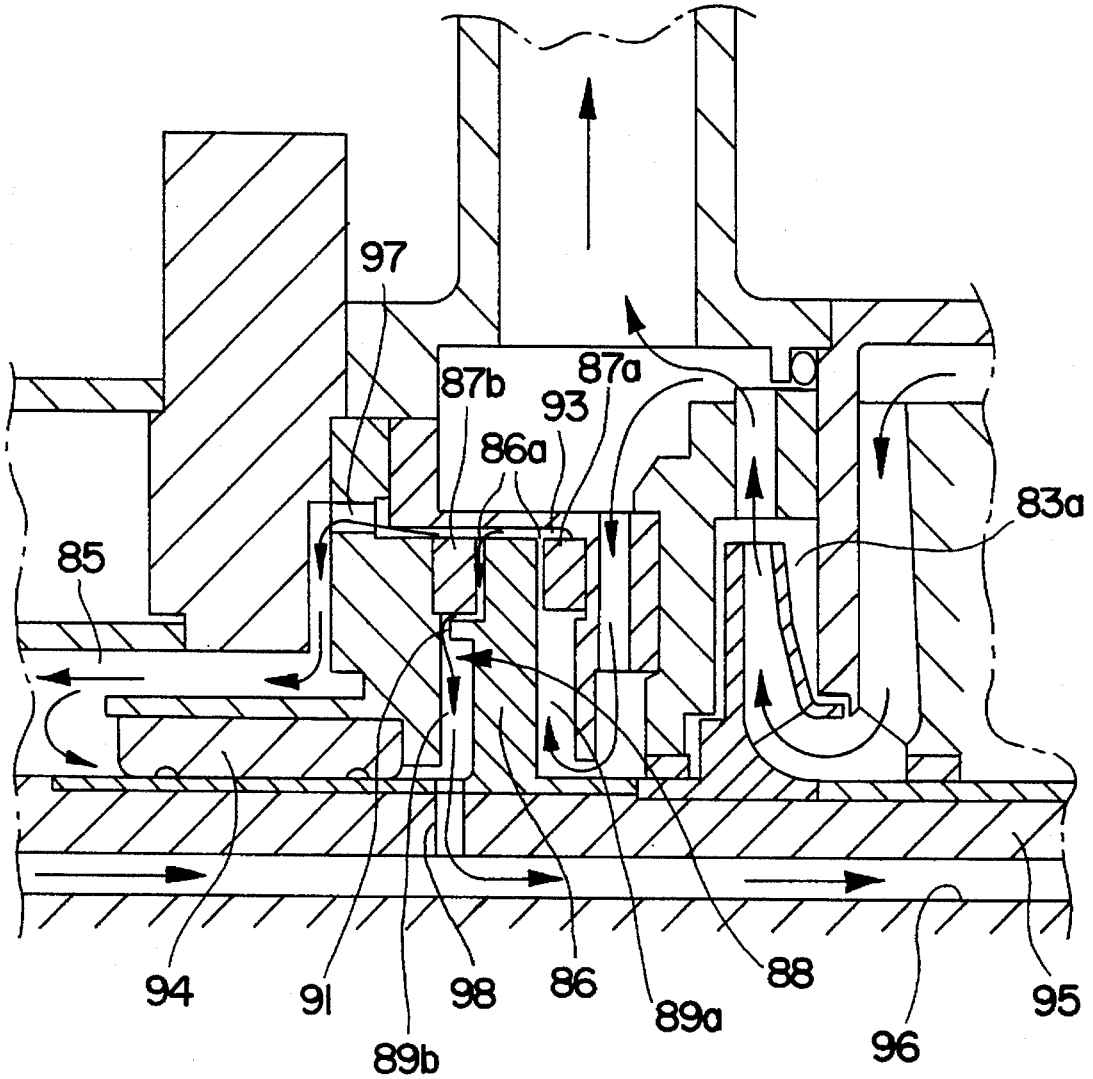
FIG. 11 is a view illustrative of a balance disk sheet of a novel multistage canned motor pump in a second embodiment according to the present invention.

The pressure chamber 88 accommodating the balance disk 86 is isolated into front and rear chambers 89*a* and 89*b* as illustrated in FIG. 11 through the balance disk 86 being provided on opposite outer side ends thereof with annulare balance sheets 87*a* and 87*b*.

The balance disk 86 is provided on its rear chamber side with a projecting portion 91 to define a balance chamber of the rear chamber 89*b* for sealing an inner peripheral verge of the rear side balance sheet 87*b*. The pressure chamber 88 has a passage 97 providing a connecting between a gap 93 outside the balance sheets 87*a* and 87*b* and the front rotor chamber 85. The balance disk 86 is provided on its contact face to the rotor shaft 95 radially extending through hole 98 connecting between the rear balance chamber 89*b* and a shaft through hole 96 on the motor rotor shaft 95.

Figure 10A:
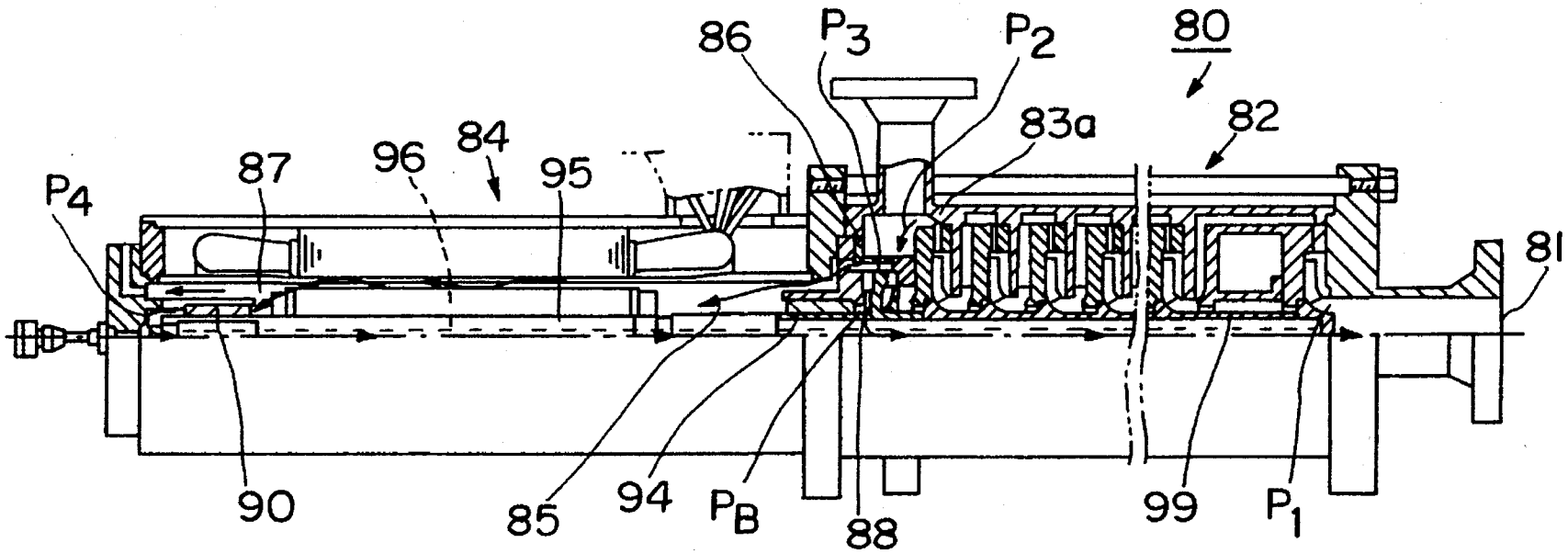
FIG. 10A is a half cross sectional elevation view illustrative of a novel multistage canned motor pump in a second embodiment according to the present invention.
Figure 10B:
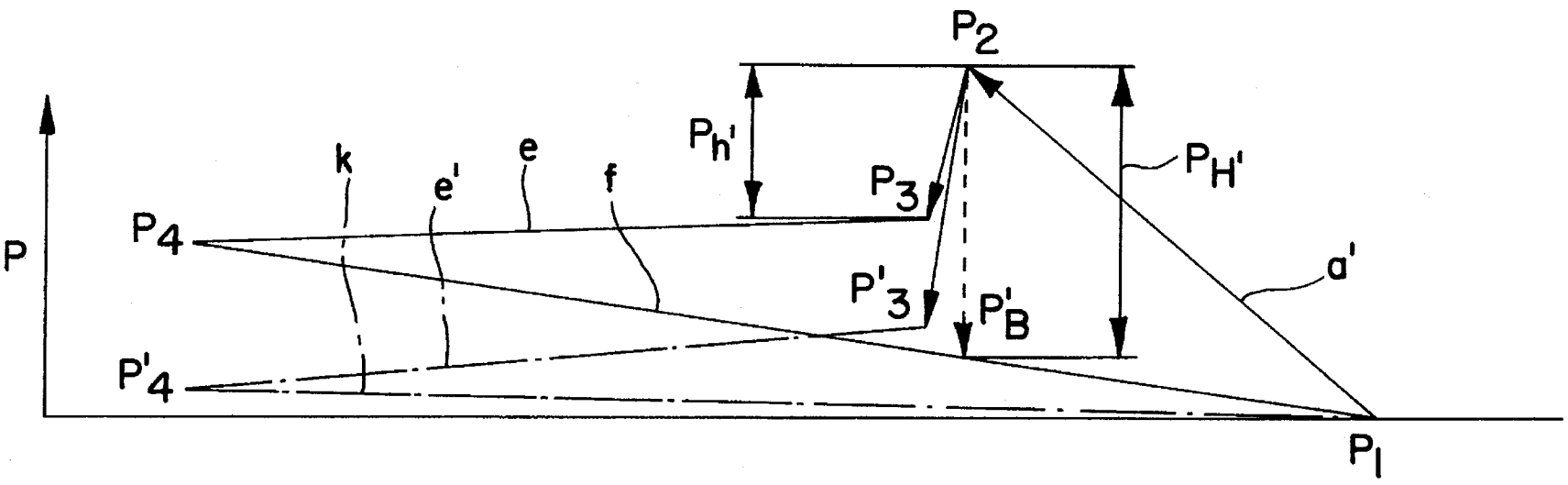
FIG. 10B is a diagram illustrative of pressure curves of each positions of a novel multistage canned motor pump in a second embodiment according to the present invention.

In FIG. 10*b*, the real line represents a pressure gradient of the internal circulation of the multistage canned motor pump. $P_1$ represents a pressure at the pump section port 81 and $P_2$ represents a pressure of the last stage pump chamber 83*a* as well as $P_3$ represents a pressure of the pressure chamber 88. $P_4$ is a rear side pressure of the motor section 84. $P_B$, is a pressure of the rear pressure chamber 89*b*. The broken line represents a pressure gradient of the external circulation of the multistage canned motor pump. $P_3$ represents a pressure of the pressure chamber 88 and $P_4$ is a rear side pressure of the motor section 84. The suction port pressure $P_1$ is raised up at the last stage pump chamber to the high pressure P2. The pressure-raised treating liquid is introduced into the pressure chamber 88 thereby the pressure $P_3$ is drop to generate a pressure difference of $P_h=P_2 \cdot P_3$.

A part of the treating liquid introduced into the pressure chamber 88 is further circulated outside the balance sheets 87*a* and 87*b* and the balance disk 86 into the motor section 84 thereby a pressure of the balance chamber 89*b* is held at a low value to keep a sufficient flow rate of the treating liquid to the motor section 84.

The pressure $P_3$ at the rear side of the motor section 84 is further dropped to the pressure $P_4$. The pressure-dropped treating liquid is circulated through the through hole 96 of the motor rotor shaft 95 to the pump suction port 8 thereby the pressure comes into the $P_1$. In this case, as the balance chamber 89*b* of the pressure chamber 88 is connected to the through hole 96, the pressure of the balance chamber 89*b* is dropped to the $P'_B$ thereby a large pressure difference $P_H$, between the maximum pressure $P_2$ and the dropped pressure $P'_B$ is generated.

On the other hand, in the external circulation system represented by the alternating dashed-dotted line in FIG. 10*b*, the pressure $P_2$ of the last pump stage is then introduced into the pressure chamber 88 where the pressure $P_2$ is dropped to the pressure $P'_3$ to be further dropped at the rear side of the motor section 84 (as shown in FIGS. 10A and 11) to the pressure $P'_4$. That is why if the treating liquid is circulated to the section port 81, then a pressure difference of $P'_4-P_1$ is reduced thereby no problem is raised.

If the through hole 98 is not provided, then the pressure $P_3$ of the pressure chamber 88 is equivalent to the pressure $P_B$ of the rear chamber 89*b*. The thrust generated at the balance disk 86 $T_1$ is changed from $A_1$ $(P_2-P_3)$ to $A_1$ $P_h$, where $A_1$ is the pressure receiving area.

By contrast, according to the present invention, the pressure $P_3$ at the rear balance chamber 89*b* is circulated around the motor section 84 and then introduced into the rear side motor section 84 where the pressure comes into a somewhat reduced pressure $P_4$. Thereafter, the treating liquid with the pressure $P_4$ is returned to the through hole 98 thereby the pressure is largely dropped to the $P'_B$. The thrust $T_2$ is changed from $A_1$ $(P_2-P_{B'})$ to $A_1$ $P_H$. A sufficient large thrust is generated.

In the external circulation system, the pressure difference $P'_4-P_1$ is small so that there is no problem.

Figure 12A:
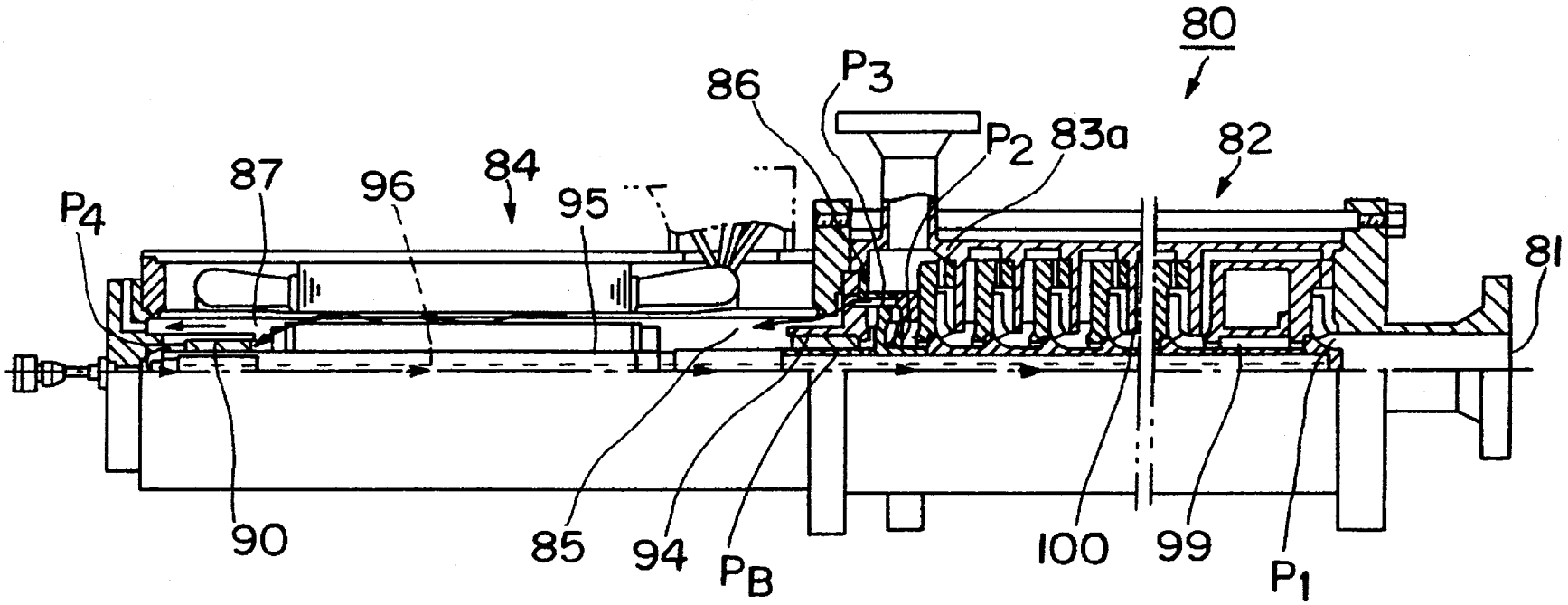
FIG. 12A is a half cross sectional elevation view illustrative of a novel multistage canned motor pump in a third embodiment according to the present invention.

In the internal circulation system, as illustrated in FIG. 12A, it is available that the through hole 86 of the motor rotor shaft 95 is provided to connect between the through hole 98 connective to the balance chamber 89*b* and the pump chamber 100 at the intermediate portion of the multistage pump chambers.

Figure 12B:
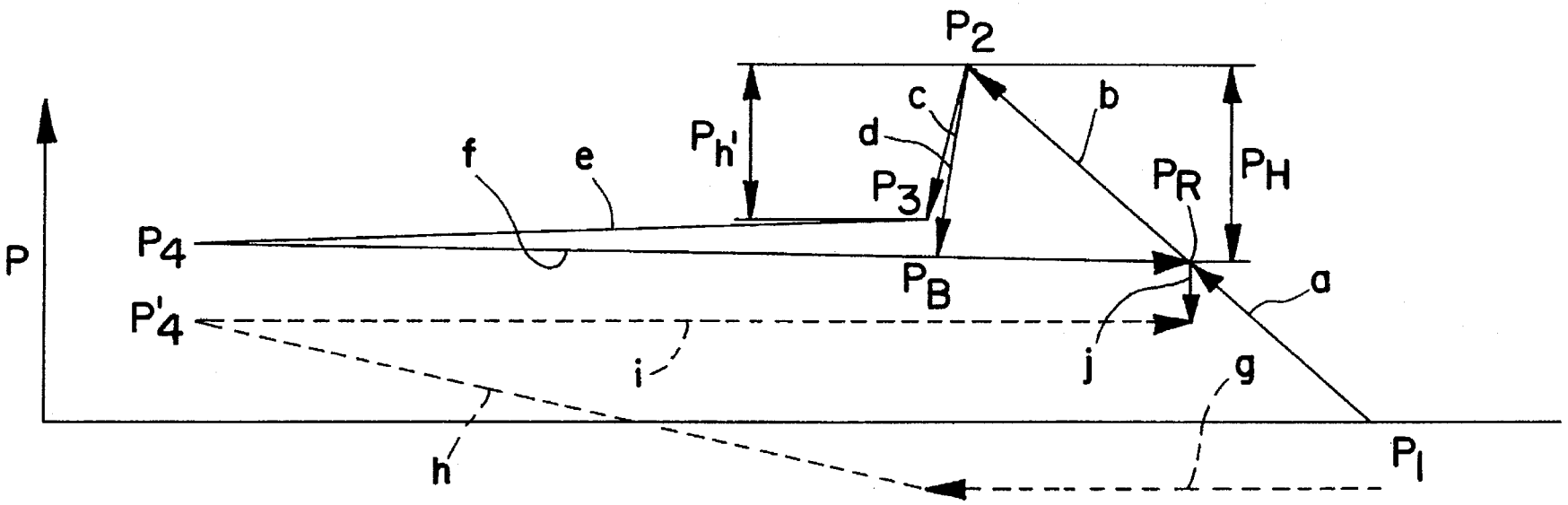
FIG. 12B is a diagram illustrative of pressure curves of each positions of a novel multistage canned motor pump in a third embodiment according to the present invention.

In FIG. 12B, the head of the first to third stage chambers is represented by a line "a" and the head of the third to sixth stage chambers is represented by a line "b". For the pressure $P_2$ of the final stage, the pressure difference thereof from the pressure $P_2$ at the front chamber 89*a* is represented by a line "c" and the pressure difference thereof from the pressure $P_2$ at the rear chamber 89*b* is represented by a line "d".

The pressure difference between the $P_3$ and $P_4$ is represented by a line "e" and the pressure difference between the $P_4$ and $P_R$ is represented by a line "f".

In FIG. 12B, as represented by a doted line, even considering the variation g of the steam pressure of the treating liquid in the pump section 82 and the pressure raising "h" due to increase of a temperature of the treating liquid in the motor section 84, there is a sufficient safety margin against the generation of the cavitation. The above structure may permit a high pressure of the motor section 84 and may suppress any generation of the cavitation even in use of a treating liquid with a high steam pressure.

Figure 13:
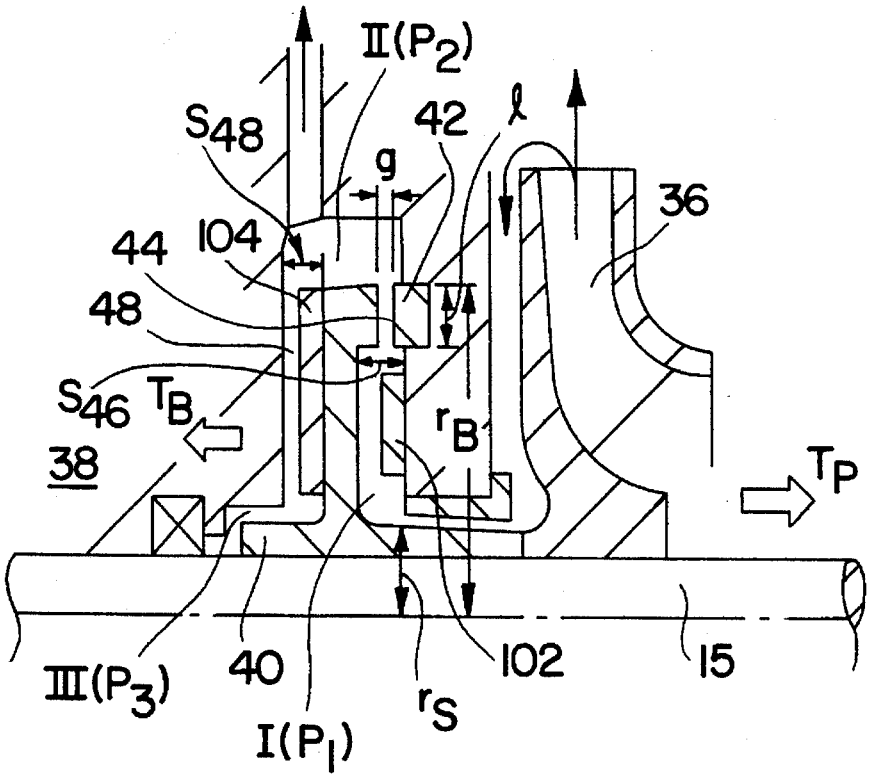
FIG. 13 is a view illustrative of a balance disk sheet of a novel multistage canned motor pump in a third embodiment according to the present invention.
Figure 14:
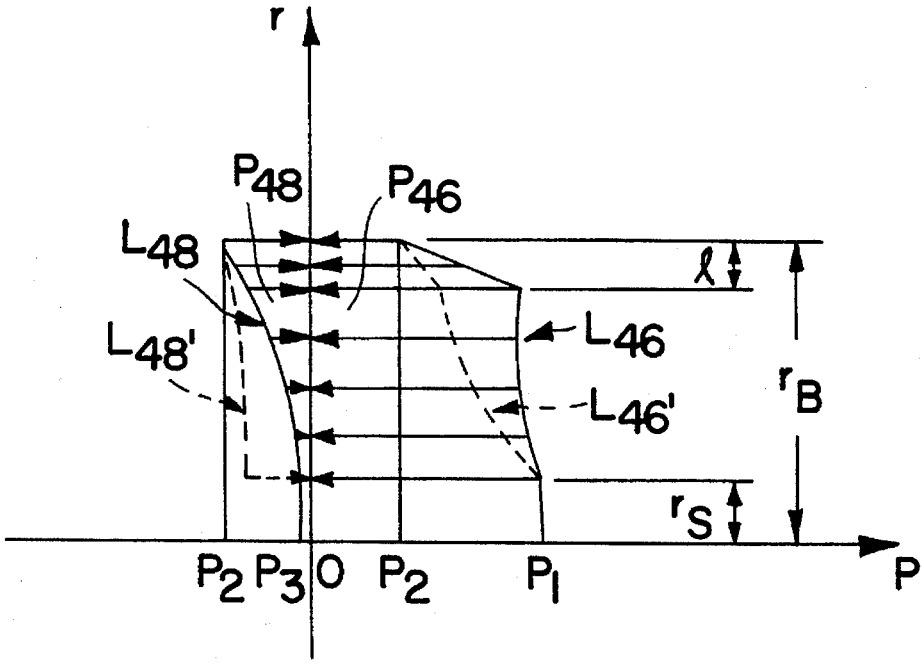
FIG. 14 is a diagram of a radius-pressure characteristic curve of the thrust balance feature of FIG. 13.
Figure 15A:
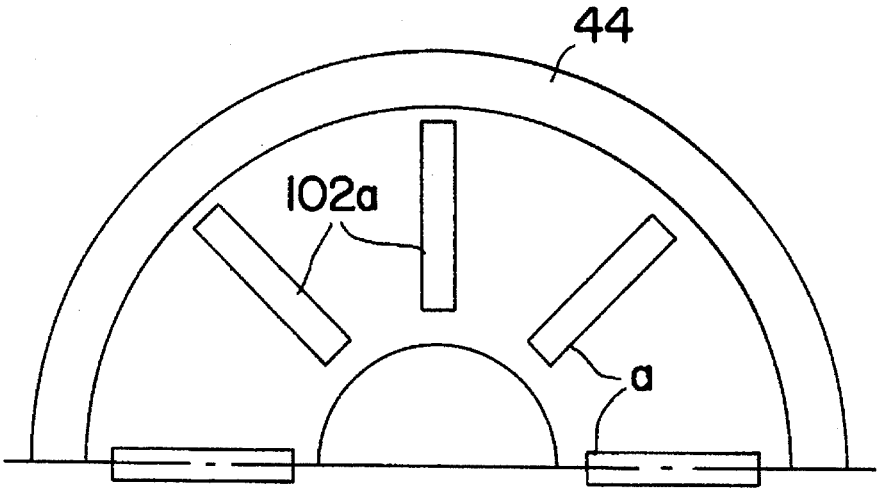
FIG. 15A is a plane view illustrative of a convex portion provided on a high pressure balance chamber wall of a thrust balance feature of FIG. 13.
Figure 15B:
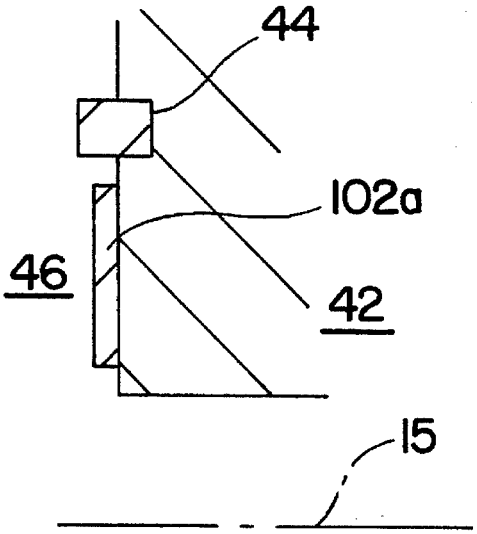
FIG. 15B is a cross sectional view illustrative of a convex portion provided on a high pressure balance chamber wall of a thrust balance feature of FIG. 13.
Figure 16A:
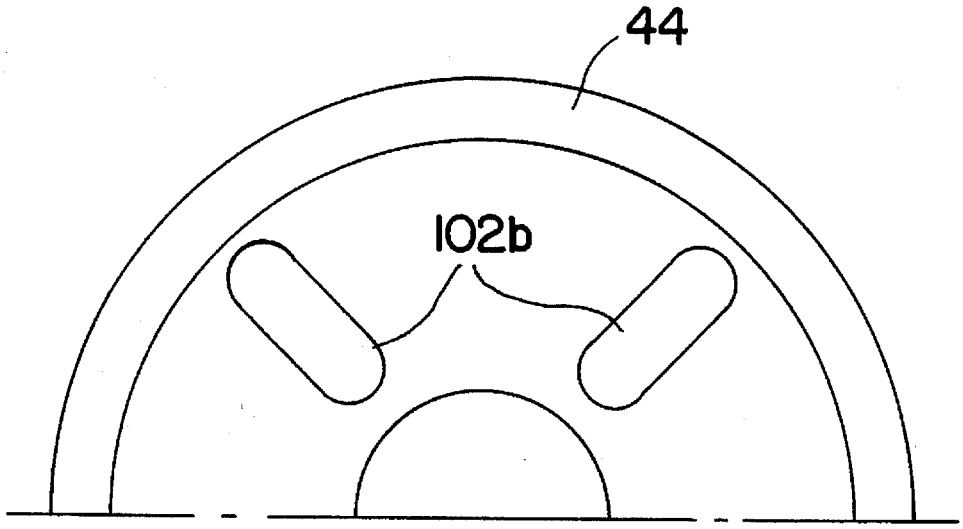
FIG. 16A is a plane view illustrative of a concave portion provided on a high pressure balance chamber wall of a thrust balance feature of FIG. 13.
Figure 16B:
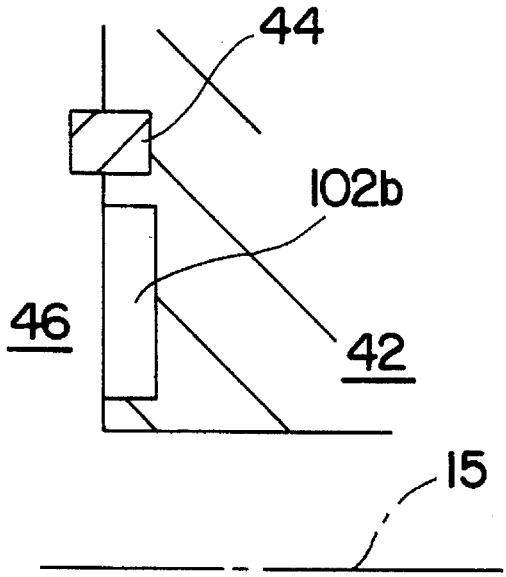
FIG. 16B is a cross sectional view illustrative of a concave portion provided on a high pressure balance chamber wall of a thrust balance feature of FIG. 13.
Figure 17A:
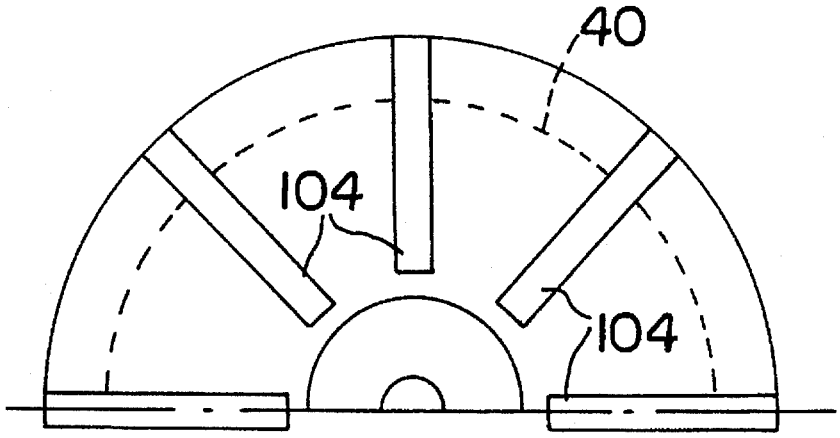
FIG. 17A is a plane view illustrative of a convex portion provided on a low pressure balance chamber wall of a thrust balance feature of FIG. 13.
Figure 17B:
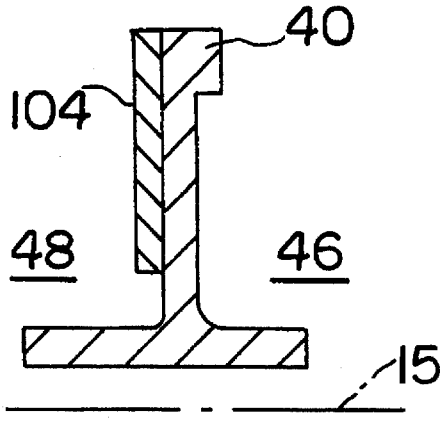
FIG. 17B is a cross sectional view illustrative of a convex portion provided on a low pressure balance chamber wall of a thrust balance feature of FIG. 13.

A third embodiment will be described with reference to FIG. 13. There is provided a thrust balance feature of a multistage canned motor pump. A high pressure treating liquid discharged from a discharge side of a last stage impeller 36 is bypassed through high and low pressure side balance chambers 46 and 48 isolated by a rotation balance disk 40 between the fixed walls 38 and a disk sheet aperture 44 between the disk 40 and the balance sheet 42 into a low pressure suction side. By the pressure drop at the aperture 44 the balance thrust $T_B$ generated between the both balance chambers 46 and 48 is balanced to the pump thrust $T_P$. Further a suppression section 10 for suppressing a circulation flow of the treating liquid at the space $S_{46}$ within the balance chamber is provided on the fixed wall 38 of the high pressure side balance chamber 46. Furthermore, a promotion section 104 for promoting a circulation flow of the treating liquid at the space $S_{48}$ in the balance chamber is provided on the rotation balance disk 40 in the low pressure balance chamber 48. The both spaces $S_{46}$ and $S_{48}$ are set at small sizes such as to effected by the rotation of the balance disk. The suppression section 102 may comprises convex portions 102*a* raidally provided on the fixed wall 38 as illustrated in FIGS. 15A and 15B or the concave portions 102*b* as illustrated in FIGS. 102*b*. The promotion section 104 may comprise convex portions 104*a* raidally provided on the balance disk 40.

The both components $P_{46}$ and $P_{48}$ of the balance thrust $T_B$ generated between the balance chambers 46 and 48 are defined by the lines $L_{46}$ and $L_{48}$. The lines $L_{46}$ and $L_{48}$ are set so that the specific peripheral speeds of the rotating treating liquids in the both spaces $S_{46}$ and $S_{48}$ come into almost zero in the high pressure chamber 46 and also come into almost 1 in the low pressure chamber 48. In the high pressure chamber 46 the rotation speed is suppressed at a low speed to keep a liquid pressure, while in the low pressure chamber 48 the rotation speed is promoted to a high speed to loss a liquid pressure.

According to the present invention, the pressure $P_{46}$ at the high pressure balance chamber 46 is increased, while the pressure $P_{48}$ at the low pressure side is dropped to increase the balance thrust by 1.5 times. So the balance thrust is considerably improved to obtain an applicability of the high head and large capacity multistage pump without a large scale modification of the available elements thereby resulting in a price down of such the pump.

Figure 18:
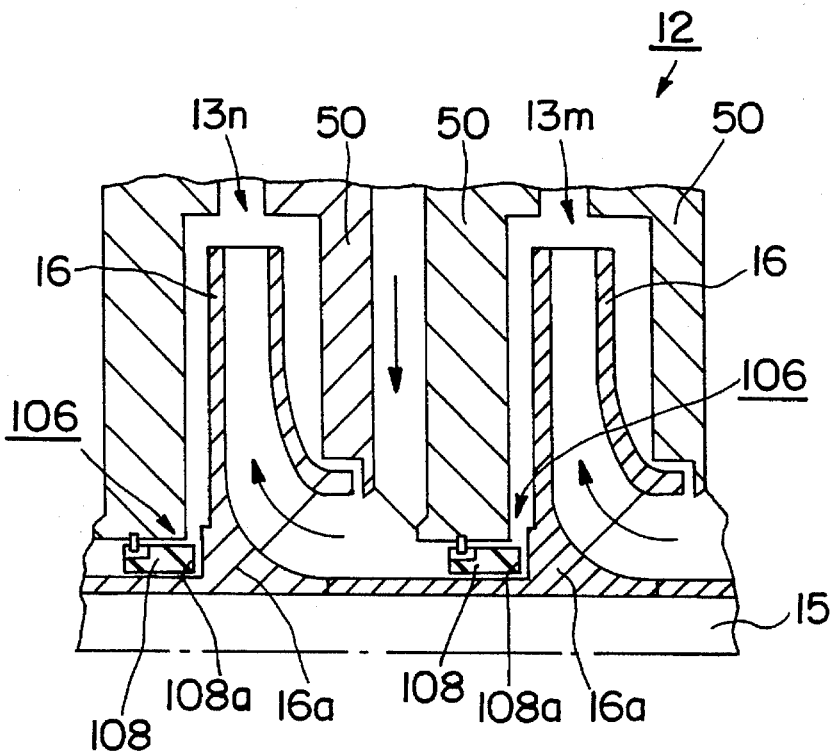
FIG. 18 is a cross sectional elevation view illustrative of a sealing structure of a novel multistage canned motor pump in a fourth embodiment according to the present invention.
Figure 19:
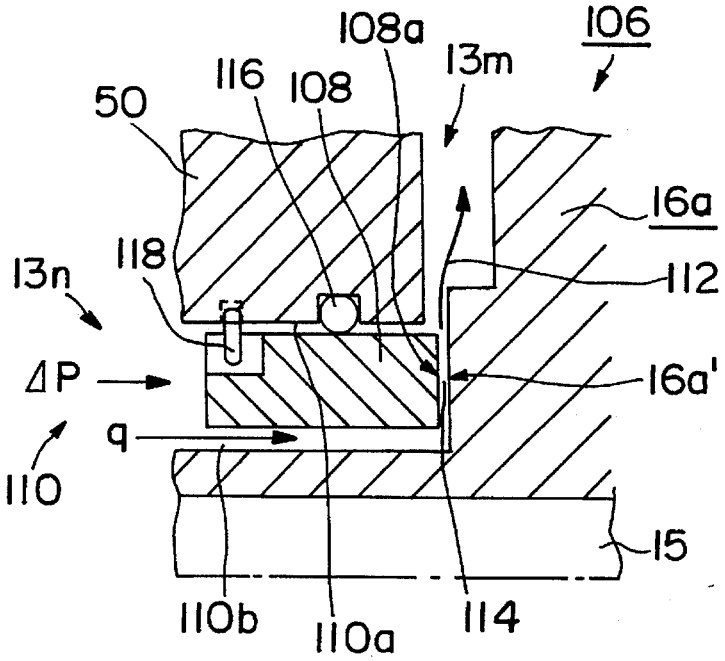
FIG. 19 is an enlarged cross sectional elevation view illustrative of a sealing structure of FIG. 18.

A fourth embodiment will be described with reference to FIG. 18. There is provided a sealing structure between individual pump stages 13 involved in a canned motor pump comprising a multistage pump section and a canned motor pump section, both of which have in common a single rotation shaft supported by a pair of bearings in the motor section and the bearings and the motor section are cooled and lubricated by a circulation flow of a part of a treating liquid. An annular sealing member 108 is provided slidably in a longitudinal direction of the rotor shaft 15 in a slidable joint member 106 formed between individual adjacent pump stages 13 so that the sealing member 108 is securely pressed by a pressure difference between the adjacent two pump stages on one having a lower pressure of the adjacent two stages for sealing of the slidable joint member. In this case, as illustrated in FIG. 19, the slidable joint member 106 may comprise an axial passage 110 extending in the longitudinal direction of the rotor shaft 15 from a low pressure chamber stage 13*n* to the high pressure chamber stage 13*m* between the fixed wall 50 of the pump chamber and a rotation boss 16*a* of the impeller and a radius passage 112 extending in a radius direction to vertically across the axial passage 110 so that the sealing member 108 is able to side in the axial passage 110 in the rotation axis direction with keeping a seal against the fixed wall 50 to thereby form a radius sealing face 114 in the radius passage between the sealing member and the rotation boss of the impeller.

The sealing member may be made of carbon or ceramic and being provided with a pin 118 or a key to keep the sealing member 108 from showing a rotation but not to permit the sealing member 108 to be slide.

A flow passage 110*a* between the sealing member 108 and the fixed wall 50 is narrow and sealed by the O-ring 116, for that reason the treating liquid discharged from the stage 13*n* of the high pressure side pump chamber is circulated through an axial passage 110*b* between the sealing member 108 and the rotation boss 16*a* of the impeller 16 and then through a radius sealing area 114 to the stage 13*m* of the low pressure side pump chamber. The leakage amount g is reduced as the radius sealing area 114 is mechanically sealed by a pressure difference between the stages 13*n* and 13*m*. The leakage amount q is reversely proportional to the pressure difference, but substantially independent from the gap of the axial flow passage 110*b* of the rotor shaft 15.

Figure 22:
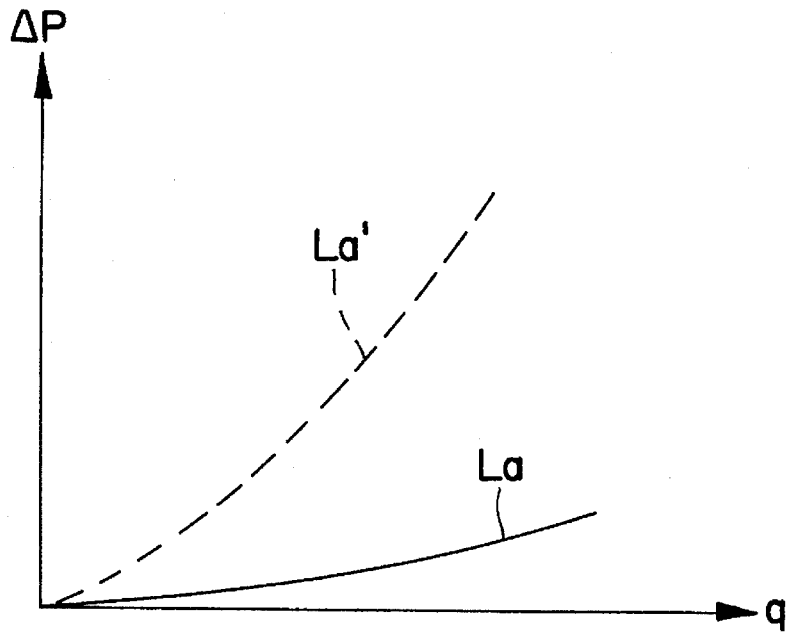
FIG. 22 is a diagram illustrative of a leakage amount q versus a pressure difference between individual adjacent pump stages in a novel multistage canned motor pump according to the present invention.
Figure 23:
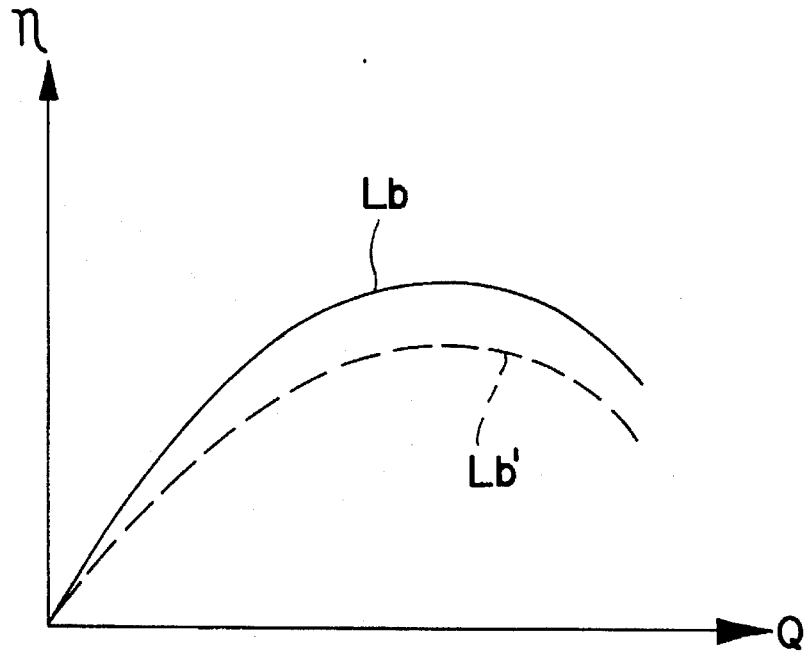
FIG. 23 is a diagram illustrative of a pump efficiency versus a pump flow rate O of a novel multistage canned motor pump according to the present invention.

The leakage amount q is reduced when the pressure difference is raised as illustrated by a characteristic curve La' in FIG. 22 thereby the pump efficiency is improved as illustrated by a characteristic curve Lb' in FIG. 23. Further, any aged deterioration is also prevented. As the pressure difference is raised up, the leakage amount q is not increased. That is why it is possible to raise the head of the stages of the pump section. This may permit a reduction of the number of the stages and a compact and simple structure thereby to curtail the manufacturing cost.

Figure 20:
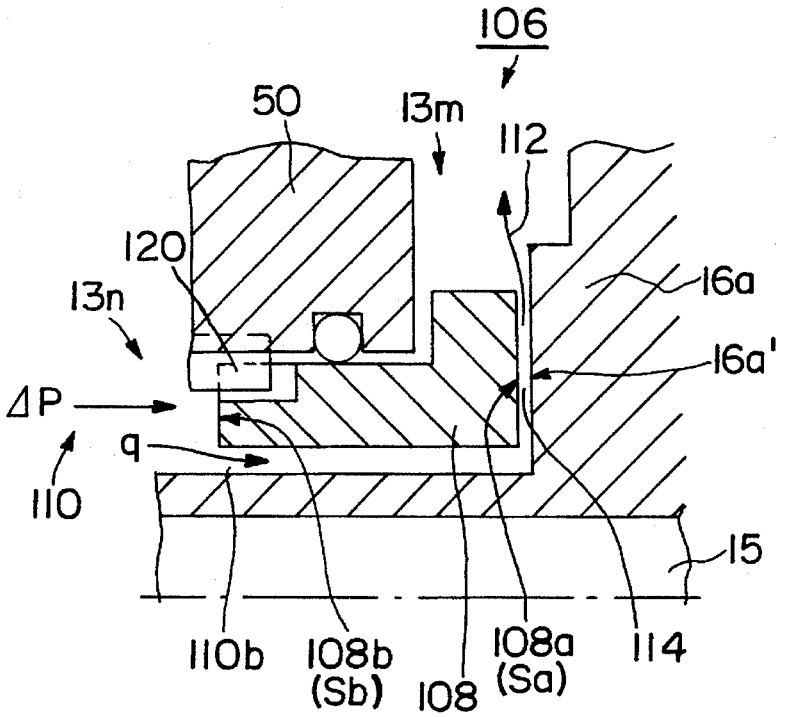
FIG. 20 is an enlarged cross sectional elevation view illustrative of another sealing structure in a fifth embodiment according to the present invention.

A fifth embodiment will be described with reference to FIG. 20. The above sealing member 108 may be so constituted that a low pressure receiving area is larger than a high pressure receiving area. The sealing member may also be so constituted that a slidable outer face is provided with a metal sleeve fixed thereon. The sealing member 108 may be formed to have a step like definition expanded in a lateral direction form other end face 108*b* in the axial passage 110 so that the pressure receiving area Sa or the end face area 108*a* at the side of the low pressure pump chamber stage 13*m* is larger than the pressure receiving area Sb or the end face area 108*b* at the side of the high pressure pump chamber stage 13*n*. As a result, a pressure on the sealing face 114 due to the pressure difference between the stages 13*m* and 13*n* is reduced to a ratio Sa/Sb of the above described pressure difference. In the large pressure difference and the large surface pressure. The sealing member 108 is further provided with a key 120 to prevent the sealing member 108 from rotation itself. The effects of the above sealing member 108 are the same as that of the fourth embodiment.

Figure 21:
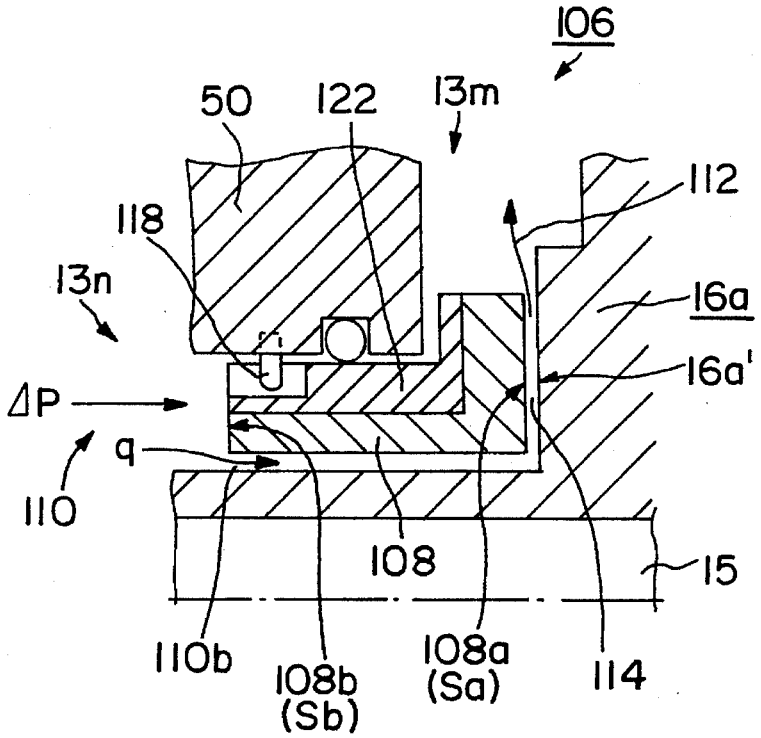
FIG. 21 is an enlarged cross sectional elevation view illustrative of another sealing structure in a sixth embodiment according to the present invention.

A sixth embodiment will be described with reference to FIG. 21. The above sealing member 108 may be provided on its peripheral surface slidable on the fixed wall 56 with a metal sleeve 122. By the pin 118, the sealing member 108 is kept from rotation but permitted to be slidable on the fixed wall 50 thereby the sealing member 108 is prevented from a frictional wear. Durability of the scaling member is also improved.

Whereas modifications of the present invention will no doubt be apparent to a person having ordinary skill in the art, to which the invention pertains, it is to be understood that the embodiments shown and described by way of illustrations are by no means intended to be considered in a limiting sense. Accordingly, it is to be intended to cover by claims any modifications of the present invention which fall within the sprit and scope of the invention.

What is claimed is:

1. A multistage canned motor pump comprising a pump section including a plurality of pump chambers and a motor section behind the pump section, wherein both the pump section and the motor section have a common single rotation shaft, and further comprising a balance disk between the pump and motor sections, wherein an internal circulation system is provided so that part of a treating liquid discharged from a last stage pump chamber is circulated from a front rotor chamber through a pressure chamber accommodating the balance disk and placed behind and adjacent to the last stage pump chamber to a rear rotor chamber while the remaining part of the treating liquid is supplied to a rear bearing section for lubrication of the bearing section and is further circulated through a shaft through hole provided in a rear end portion of a motor rotor shaft and to a pump suction port for cooling of the motor section, wherein the pressure chamber is isolated into front and rear chambers through the balance disk by having on one outer side of the balance disk with a first balance sheet forming a face seal and on an opposite side of the balance disk a second balance sheet for forming an annular seal and wherein the balance disk is provided on its rear chamber side with a projecting portion for forming a balance chamber for sealing the inner peripheral verge of the rear side balance sheet, and wherein the pressure chamber is provided with a passage connecting between a gap outside the rear side balance sheet and the front rotor chamber, and wherein the balance disk is provided with a balance through hole connecting the balance chamber and the shaft through hole.

2. The pump as claimed in claim 1, wherein the balance through hole connecting to the shaft through hole of the motor rotor shaft is provided on the suction side of at least one of the pump chambers.

* * * * *